US010008075B2

(12) United States Patent
Berman

(10) Patent No.: US 10,008,075 B2
(45) **Date of Patent: *Jun. 26, 2018**

(54) SYSTEMS, APPARATUSES AND METHODS FOR ENHANCING GAMING EXPERIENCES

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/437,412

(22) Filed: Feb. 20, 2017

(65) Prior Publication Data

US 2017/0178460 A1 Jun. 22, 2017

Related U.S. Application Data

(63) Continuation of application No. 13/938,178, filed on Jul. 9, 2013, now Pat. No. 9,576,437, and a continuation-in-part of application No. 12/850,826, filed on Aug. 5, 2010, now Pat. No. 9,576,431.

(60) Provisional application No. 61/708,183, filed on Oct. 1, 2012, provisional application No. 61/231,951, filed on Aug. 6, 2009.

(51) Int. Cl.
*G07F 17/32* (2006.01)

(52) U.S. Cl.
CPC ..... *G07F 17/3293* (2013.01); *G07F 17/3211* (2013.01); *G07F 17/3227* (2013.01); *G07F 17/3267* (2013.01)

(58) Field of Classification Search
CPC ..... G07F 17/3293; G07F 17/3267; G07F 17/3211; G07F 17/3227
See application file for complete search history.

(56) References Cited

U.S. PATENT DOCUMENTS

| | | | |
|---|---|---|---|
| 5,788,573 | A | 8/1998 | Baerlocher et al. |
| 5,823,873 | A | 10/1998 | Moody |
| 6,007,066 | A | 12/1999 | Moody |
| 6,098,985 | A | 8/2000 | Moody |
| 6,213,876 | B1 | 4/2001 | Moore |
| 6,224,483 | B1 | 5/2001 | Mayeroff |
| 6,334,814 | B1 | 1/2002 | Adams |
| 6,517,074 | B1 | 2/2003 | Moody et al. |
| 6,612,927 | B1 | 9/2003 | Slomiany et al. |
| 6,652,377 | B1 | 11/2003 | Moody |
| 7,247,092 | B2 | 7/2007 | Jarvis et al. |
| 7,354,342 | B2 | 4/2008 | Paulsen et al. |
| 8,147,310 | B2 | 4/2012 | Jarvis et al. |
| 8,419,518 | B2 | 4/2013 | Jarvis et al. |
| 8,439,737 | B1 | 5/2013 | Moody |

(Continued)

OTHER PUBLICATIONS

King Show Games, Inc., "Listing of Related Cases," Jul. 25, 2016, 1 page.

*Primary Examiner* — Jasson Yoo

(57) ABSTRACT

Systems, apparatuses and methods for enhancing winning result opportunities in poker gaming activities. Embodiments involve identifying award-enhancing opportunities using dice to determine award-enhancing opportunities based on the dice results for a poker game played on a gaming device. Award-enhancing opportunities can be accumulated during multiple bonus rounds, or single bonus rolls of dice may be used to determine multipliers or other modifiers to enhance awards received in the poker games.

20 Claims, 23 Drawing Sheets

(56) References Cited

U.S. PATENT DOCUMENTS

| | | | | |
|---|---|---|---|---|
| 8,668,573 | B1 * | 3/2014 | Mayeroff | G07F 17/3211 463/16 |
| 2002/0082074 | A1 | 6/2002 | Bennett | |
| 2003/0064790 | A1 | 4/2003 | Hughs-Baird et al. | |
| 2003/0071417 | A1 * | 4/2003 | Webb | A63F 3/00157 273/292 |
| 2004/0002376 | A1 | 1/2004 | Swift et al. | |
| 2004/0152498 | A1 | 8/2004 | Kaminkow et al. | |
| 2004/0229670 | A1 | 11/2004 | Potter et al. | |
| 2005/0148383 | A1 | 7/2005 | Mayeroff | |
| 2005/0173863 | A1 * | 8/2005 | Walker | G07F 17/32 273/292 |
| 2006/0040723 | A1 | 2/2006 | Baerlocher et al. | |
| 2006/0063584 | A1 * | 3/2006 | Brill | G07F 17/3244 463/20 |
| 2006/0160595 | A1 * | 7/2006 | Gerson | G07F 17/32 463/16 |
| 2006/0223615 | A1 * | 10/2006 | Englman | G07F 17/3211 463/17 |
| 2007/0167208 | A1 | 7/2007 | Acres | |
| 2008/0113760 | A1 | 5/2008 | Baerlocher | |
| 2008/0146305 | A1 | 6/2008 | Moody | |
| 2009/0111556 | A1 | 4/2009 | Moody | |
| 2009/0117993 | A1 | 5/2009 | Bigelow et al. | |
| 2009/0258695 | A1 | 10/2009 | Graham et al. | |
| 2011/0034233 | A1 * | 2/2011 | Berman | G07F 17/3267 463/20 |
| 2011/0312409 | A1 | 12/2011 | Vancura | |
| 2013/0029750 | A1 | 1/2013 | Moody | |
| 2013/0217457 | A1 | 8/2013 | Jarvis et al. | |

* cited by examiner

| | 500 DICE ROLL | 502 MULTIPLIER |
|---|---|---|
| 504 | 2 | 10x |
| | 3 | 6X |
| | 4 | 4X |
| | 5 | 3X |
| | 6 | 2X |
| 508 | 7 | 1ST ROLL: 7X<br>AFTER 1ST ROLL: END |
| | 8 | 2X |
| | 9 | 3X |
| | 10 | 4X |
| | 11 | 6X |
| 506 | 12 | 10x |

FIG. 5

| | 700 DICE ROLL | 702 FREE SPINS |
|---|---|---|
| 704 | 2 | +10 |
| 708 | 3 | +5 |
| | 4 | +3 |
| | 5 | +2 |
| | 6 | +1 |
| 712 | 7 | 1ST SPIN: +7<br>AFTER 1ST ROLL: END |
| | 8 | +1 |
| | 9 | +2 |
| | 10 | +3 |
| 710 | 11 | +5 |
| 706 | 12 | +10 |

FIG. 7

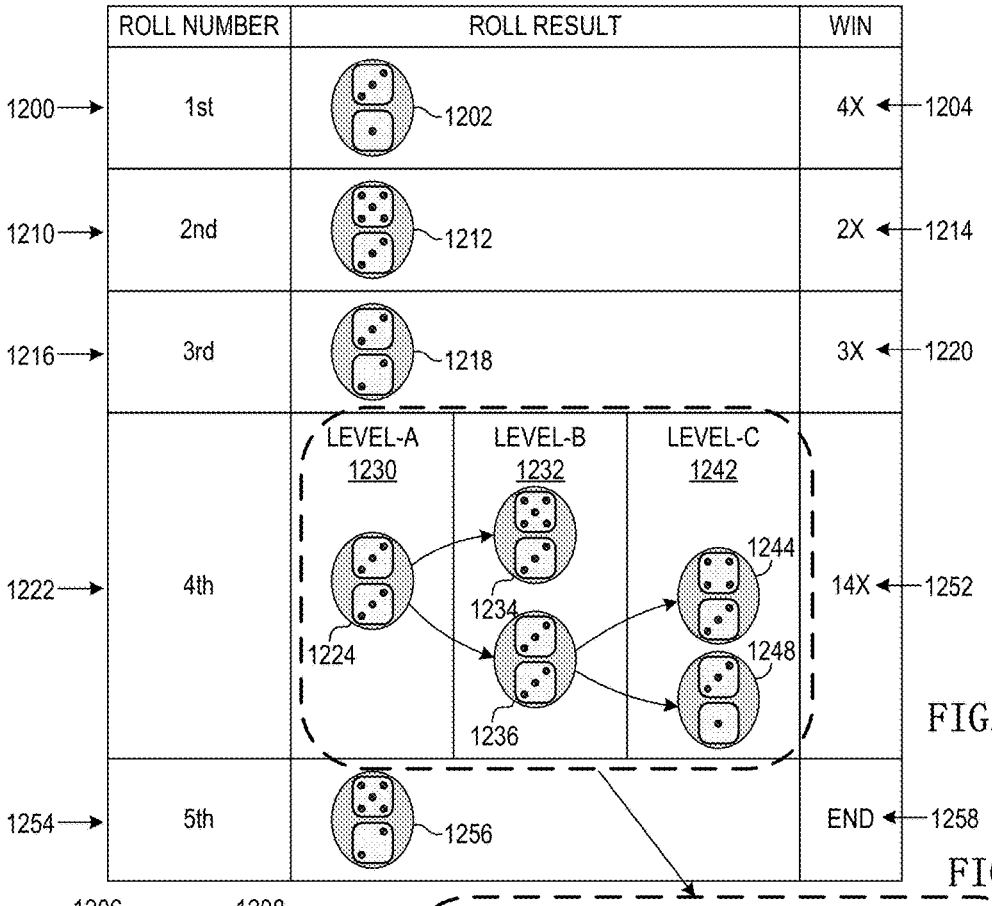
FIG. 12A
| ROLL | WIN |
|---|---|
| 3 OR 11 | 6X |
| 4 OR 10 | 4X |
| 5 OR 9 | 3X |
| 6 OR 8 | 2X |
| 7 (on first roll) | 13X (END) |
| 7 (after first roll) | (END) |
| (1-1) OR (6-6) | 20X |
| (2-2) OR (5-5) | 8X |
| (3-3) OR (4-4) | 4X |
1206 1208
FIG. 12B
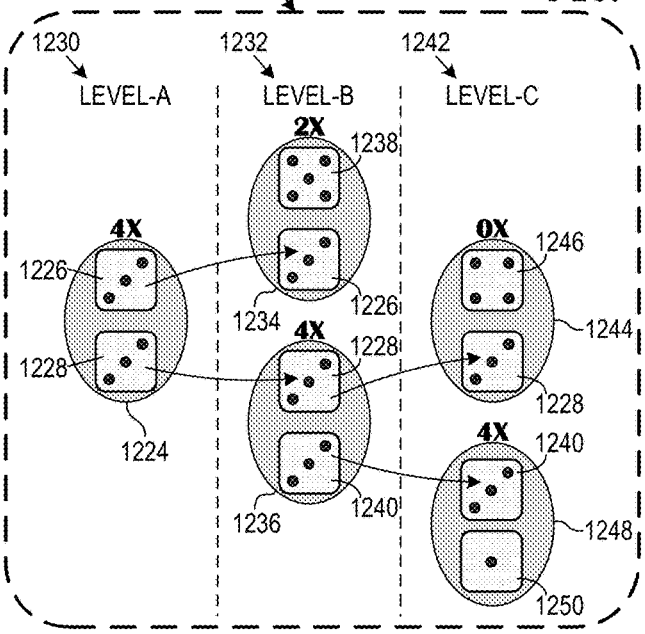
FIG. 12c

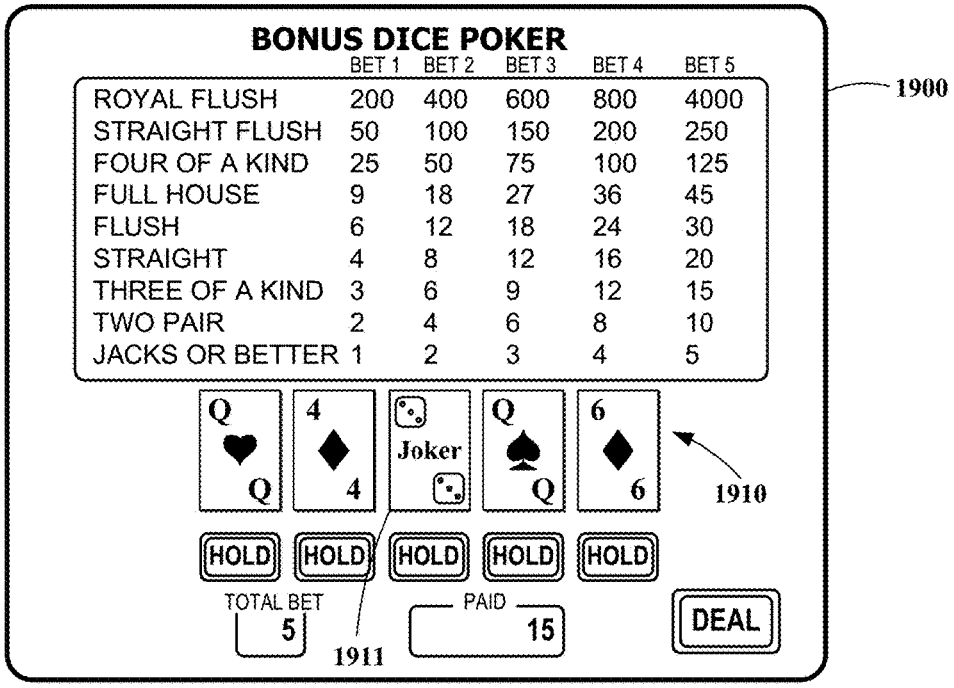
FIG. 19A
FIG. 19B
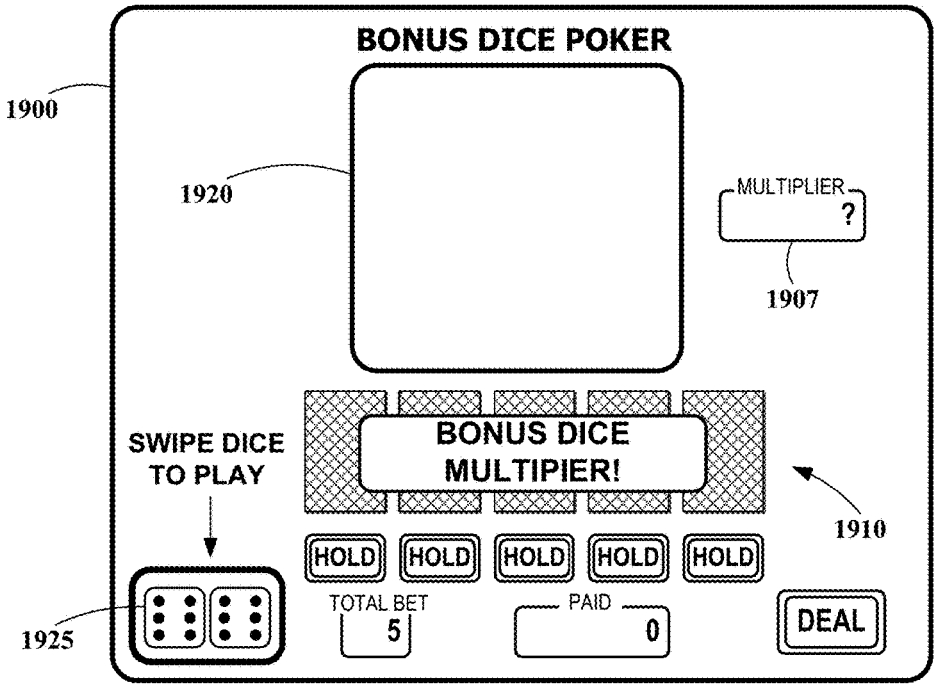

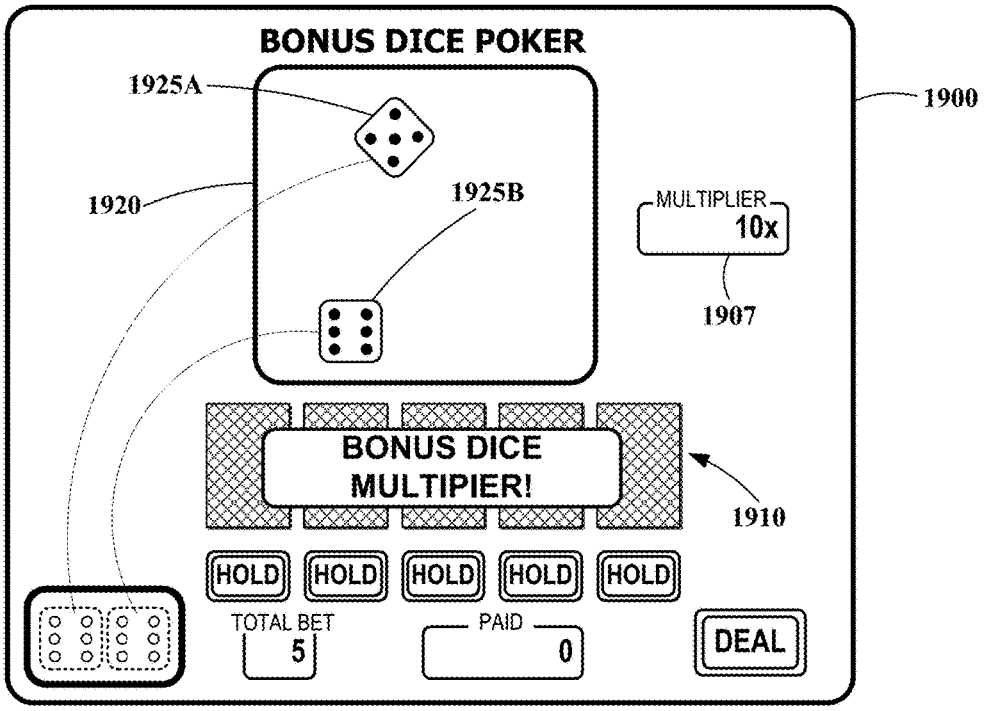
FIG. 19C
FIG. 19D
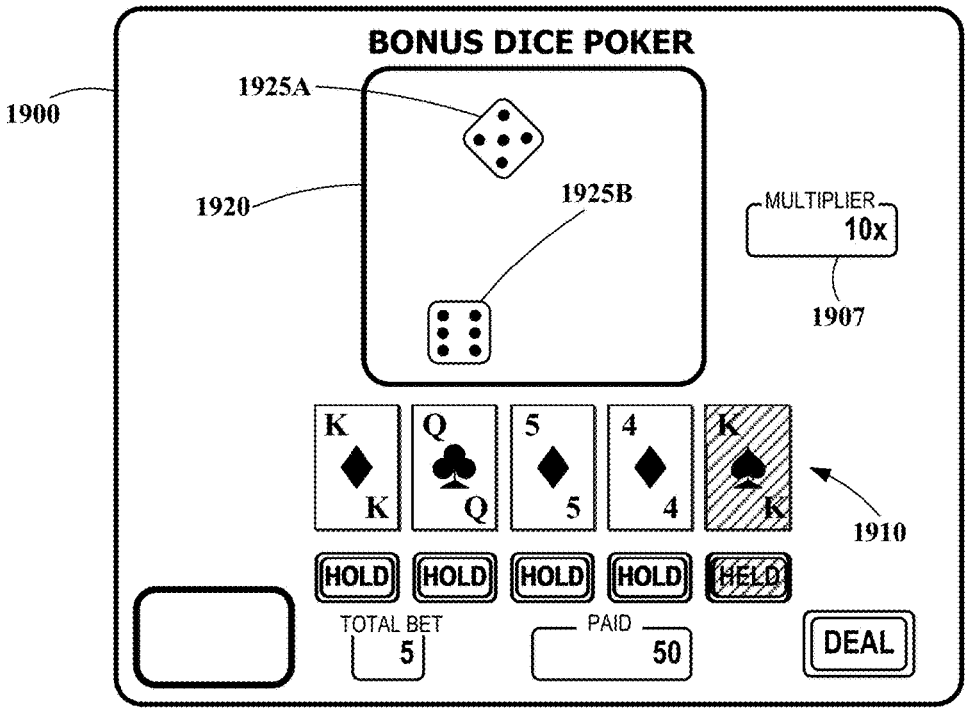

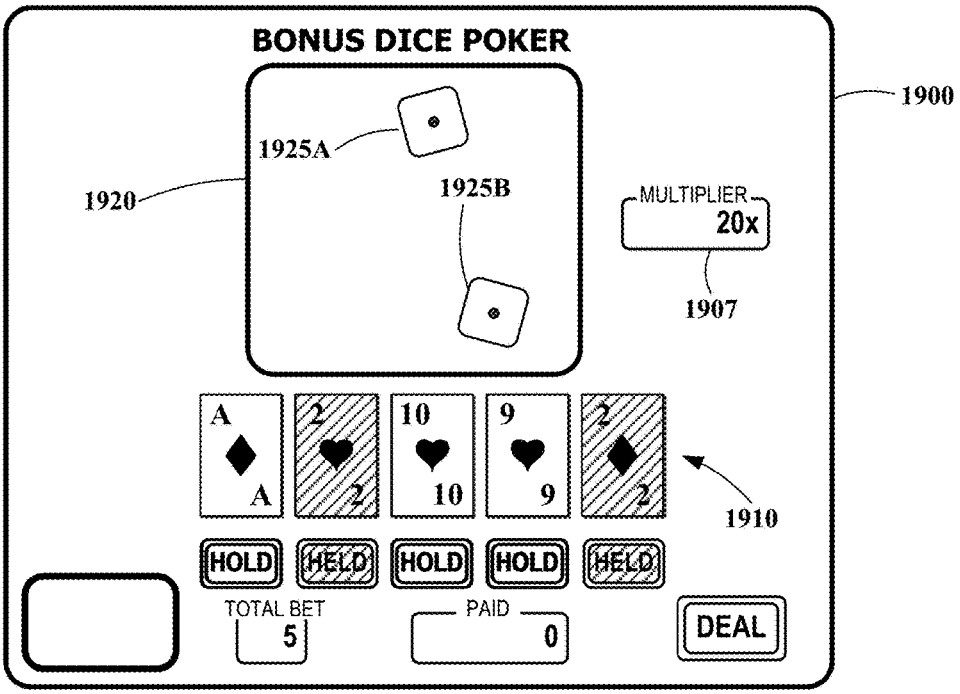
FIG. 19E
FIG. 19F
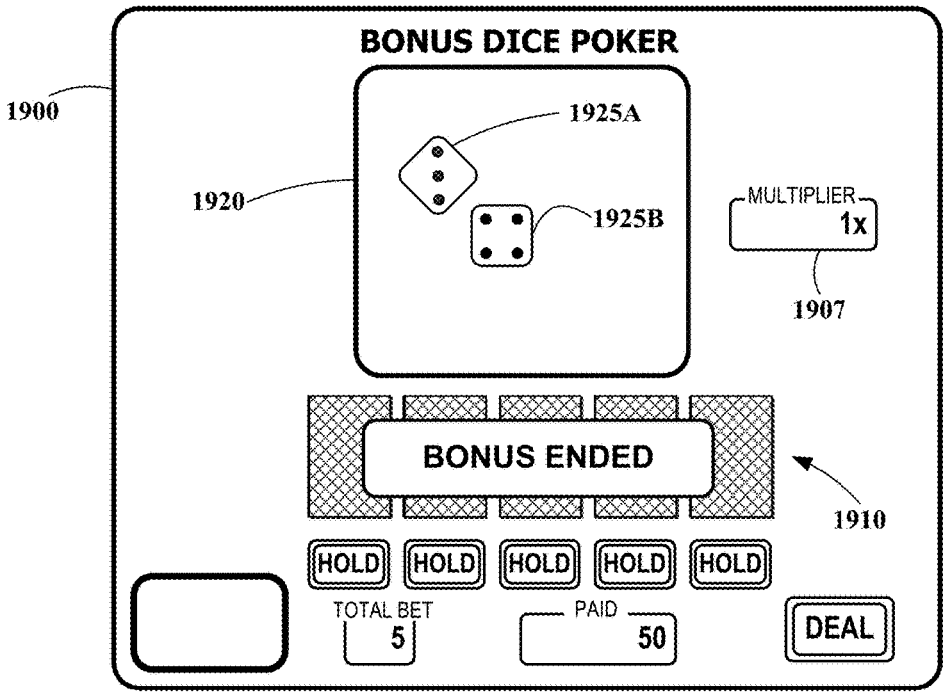

SYSTEMS, APPARATUSES AND METHODS FOR ENHANCING GAMING EXPERIENCES

RELATED APPLICATIONS

This application is a continuation of U.S. application Ser. No. 13/938,178, filed Jul. 9, 2013, which claims the benefit of Provisional Patent Application No. 61/708,183, filed on Oct. 1, 2012, to which priority is claimed pursuant to 35 U.S.C. § 119(e), and is a continuation-in-part of U.S. application Ser. No. 12/850,826 filed on Aug. 5, 2010, which claims benefit of Provisional Patent Application No. 61/231,951, filed on Aug. 6, 2009, to which priority is claimed pursuant to 35 U.S.C. § 119(e), all of which is incorporated herein by reference in its entirety.

FIELD

This invention relates in general to games, and more particularly to systems, apparatuses and methods for providing game features, such as slot game features.

BACKGROUND

It is desirable to provide captivating gaming opportunities for game players to maintain player interest, particularly where there are multiple chances of winning and/or increasing payout awards. In furtherance of the need to attract participants to particular gaming machines, there is a continuing need to further the excitement and anticipation in the participation of gaming activities. The present invention fulfills these and other needs, and offers advantages over prior art gaming approaches.

SUMMARY

To overcome limitations in the prior art described above, and to overcome other limitations that will become apparent upon reading and understanding the present specification, the present invention discloses systems, apparatuses and methods for providing game features.

In accordance with one embodiment, a method is provided that includes facilitating participation in a gaming event. A die/dice is presented, and an award-enhancing opportunity is identified in response to a number presented on the die/dice. The method involves enabling repetition of the presentation of the die/dice and the identification of the award-enhancing opportunity in response to the number presented until a triggering event occurs by way of the presentation of the die/dice, and enabling aggregation of the identified award-enhancing opportunities occurring during the repetition. Payout opportunities relative to the participation in the gaming event are enhanced using the aggregation of the identified award-enhancing opportunities.

In a more particular example of this method, a primary or base game may be a poker game where a die/dice feature multiply or modify wins that occur on the poker hand(s) of the poker game. Here, the method includes receiving signals from the user interface to place a wager on a primary poker game and determining with the processor if a bonus dice feature is triggered. If the bonus dice feature is triggered, the game then determines a dice value outcome and associates the dice value outcome with a bonus multiplier. In the poker game, multiple cards are provided to form a dealt poker hand on the display, and cards may be held and replacement cards drawn for non-held cards to form a final poker hand. Awards for the final poker hand are determined and multiplied by the bonus multiplier.

In another representative variation, multiple hands of poker are presented as a primary game where a die/dice feature is used to multiply or modify at least one of the multiple poker hands when the die/dice feature is triggered.

Other embodiments involve a computer-readable medium(s) that has instructions stored thereon that are executable by a computing system by performing functions associated with any of the method embodiments described herein.

These and various other advantages and features of novelty are pointed out with particularity in the claims annexed hereto and form a part hereof. However, for a better understanding of the operation and advantages, reference should be made to the drawings which form a further part hereof, and to accompanying descriptive matter, in which there are illustrated and described representative examples of systems, apparatuses, and methods associated with the invention.

BRIEF DESCRIPTION OF THE DRAWINGS

The description herein refers to embodiments illustrated in the following diagrams.

FIG. 5 illustrates a representative correlation between dice roll results and their impact on payouts of the gaming event using mathematical augmentation;

FIG. 7 illustrates a representative correlation between dice roll results and their impact on payouts of the gaming event through increased opportunities in a primary gaming event;

FIGS. 12A-12C are diagrams depicting an embodiment for enhancing awards using a dice splitting feature;

FIGS. 19A-19F are diagrams of a game display showing another example game progression according to embodiments of the invention.

DETAILED DESCRIPTION

Figure 1:
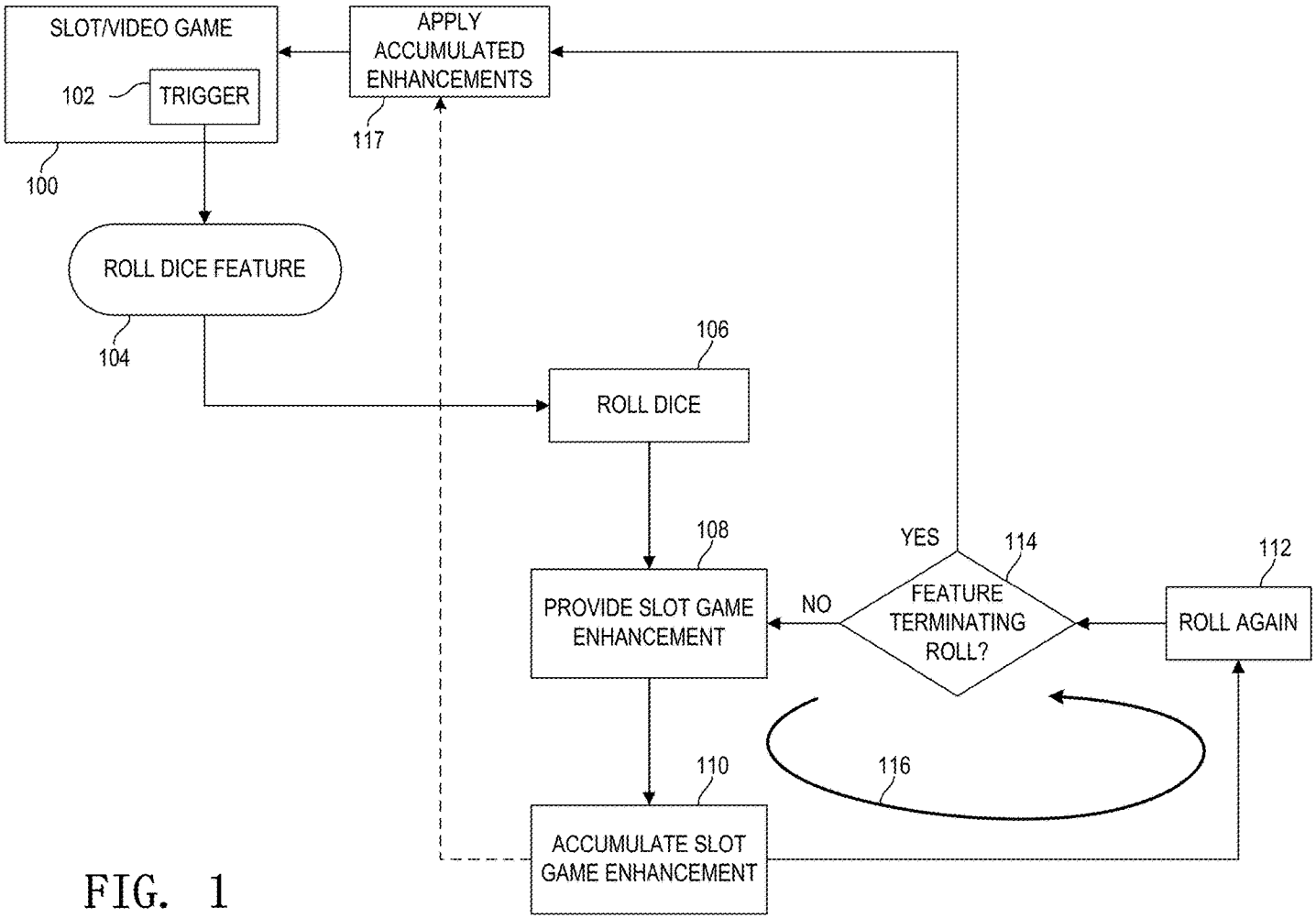
FIG. 1 illustrates a representative manner for enhancing award opportunities in connection with a gaming event.

In the following description of various exemplary embodiments, reference is made to the accompanying drawings which form a part hereof, and in which is shown, by way of illustration, representative embodiments in which the invention may be practiced. It is to be understood that other embodiments may be utilized, as structural and operational changes may be made without departing from the scope of the invention.

Generally, systems, apparatuses, and methods are provided for enhancing winning result opportunities in individual or group gaming activities. Embodiments involve identifying award-enhancing opportunities using an actual or virtual die/dice, and enabling repetition of such award-enhancing opportunities based on the die/dice results until a terminating event occurs using the die/dice.

For example, one representative method is used in connection with a gaming event, such as a slot game where payouts are provided for certain matching symbols in a symbol display grid. A die/dice is presented, and award-enhancing opportunities are identified in response to the die/dice "roll" or other presentation. In such an embodiment, the die/dice presentation and corresponding award-enhancing opportunities are allowed to repeat, thereby aggregating award-enhancing opportunities, until the die/dice provide a result that triggers the end of the award-enhancing opportunities. In this manner, payout opportunities are enhanced in the original gaming event.

Other embodiments involve an apparatus configured to enhance awards/payouts in such a manner. For example, a display may be configured to present the die/dice, and a processor may be configured to identify award-enhancing opportunities in response to the die/dice presentation. In such an example, the processor is configured to allow the die/dice presentation and corresponding award-enhancing opportunities to repeat, and aggregate the award-enhancing opportunities, until the die/dice provide a result that triggers the end of the award-enhancing opportunities. The processor may also be configured to calculate payouts that are statistically, or at least perceived to be, more likely to occur.

Another representative method presents a die/dice, and identifies a mathematical augmentation value in response to a number presented on the die/dice. Some number of repetitions of the die/dice presentations (e.g., "rolls") and resulting mathematical augmentation value identifications are guaranteed. An example is to guarantee four free spins in the primary game, where each free spin is also associated with one of the dice rolls and mathematical augmentation value identifications. In this embodiment, following the guaranteed number of repetitions of dice rolls and mathematical augmentation value identifications, conditional repetition of the presentation of the die/dice and mathematical augmentation value identification is provided until a triggering event occurs by way of the presentation of the die/dice. Payout opportunities relative to the participation in the gaming event may be enhanced using the identified mathematical augmentation values.

The systems, apparatuses and methods described herein may be implemented as a single game, or part of a multi-part game. For example, the games described herein may be implemented in a primary slot game, and/or in a bonus game(s) or other secondary games associated with a primary slot game. Thus, while various embodiments described herein may be described in terms of a bonus event of a gaming activity, it is equally applicable to main/primary gaming and other non-bonus events. The invention may be used as a stand-alone game, a primary/base game of a slot game, a bonus game of a slot game, a community bonus game for a gaming system having multiple gaming devices, etc.

A representative embodiment for enhancing award opportunities in connection with a gaming event is shown in FIG. 1. In this embodiment, the gaming event or activity is a slot or video game 100. For example, the game 100 may represent a slot game where mechanical or virtual/electronic reels or other symbols in display segments are "spun" or otherwise rearranged to provide a random presentation of the symbols. When certain symbols are presented in a matching fashion, or otherwise conform to symbol arrangement rules, the result is a winning symbol combination(s) in which payouts may be made when implemented in a wagering environment.

The embodiment of FIG. 1 includes a secondary feature, which is depicted as a dice feature 104 in FIG. 1. The dice feature 104 may be provided in connection with a primary or native game of the slot/video game 100, or in connection with a secondary or bonus event. The feature 104 may be allowed to occur at all times during play of the game 100, in connection with predetermined events, at random times, in response to triggering events, and/or in connection with other times or events established by the rules of the game. In the illustrated embodiment, the feature 104 is initiated upon the occurrence of a triggering event 102 occurring in the slot/video game 100. As merely an example of such a triggering event, assume the game 100 represents a slot game, in which case the presentation of a predetermined number of a particular symbol may trigger the roll dice feature 104. As a more particular example, the trigger 102 may involve obtaining three established bonus symbols anywhere on the presented "reels" or other display segments of the primary gaming event 100.

The roll dice feature 104 of the embodiment of FIG. 1 includes rolling at least one die, as shown at block 106. "Rolling" the die/dice in this regard may involve physically rolling a die/dice, providing a visual representation (e.g., graphical or other electronic display) of rolling a die/dice, providing a visual representation of the face(s) of the die/dice, etc. References to "rolling" the die/dice is meant to broadly represent changing or otherwise presenting the result of the face(s) of the die/dice, and is not intended to require actual or visual movement or rolling of the die/dice, although some embodiments involve such actual/visual movement. It should also be noted that while the player may initiate or otherwise have total or partial control of "rolling"

the actual or virtual dice, this may be an automatic feature or otherwise out of the player's control in other embodiments.

As a result of rolling the die/dice 106, one embodiment involves providing a slot game enhancement 108. In this embodiment, the player is guaranteed at least one slot game enhancement 108, although other embodiments may disallow any slot game enhancement if the result of the die/dice roll is a terminating roll (which are discussed in greater detail below). However, in the illustrated embodiment, the first roll of the die/dice results in the player obtaining at least one slot game enhancement 108. The slot game enhancement, also referred to herein as an award-enhancing opportunity, represents some potential or actual benefit to the player, whether or not it ultimately increases the player's payout. For example, one example of a slot game enhancement is a mathematical function that can increase the player's payout in the slot game 100, or at least a chance to increase the player's payout in the slot game 100. In another example, the slot game enhancement is one or more free plays or free "spins" in the primary slot game 100. These and other award-enhancing opportunities are contemplated for use in connection with the description provided herein. In some embodiments, there is still a perceived benefit to the player, such as by providing multipliers or free spins, even though the ultimate outcome does not actually increase the payout to the player.

The embodiment of FIG. 1 involves accumulating the acquired slot game enhancements as shown at block 110. In one embodiment this involves enabling repetition of the rolling of the dice and identification of slot game enhancements, and accumulating any provided slot game enhancements. This repetition is depicted in FIG. 1 by enabling a further roll 112 of the dice, and determining if the roll 112 of the dice represents a terminating roll as determined at decision block 114. If not, a slot game enhancement 108 is again provided based on the result of the die/dice roll. This can continue to repeat, as depicted by arrow 116, until it is determined 114 that a terminating roll occurred. The terminating roll may be, for example, a particular number(s) presented on the die/dice. In one embodiment, a processor may be utilized to compare the presented dice roll result 108/112 to established die/dice setpoints to determine whether the presented die/dice roll will provide a slot game enhancement 108 or result in a terminating roll 114. Comparators and/or other comparison circuitry may also be used to make such a determination.

As an even more specific, representative example, a terminating roll may be a roll of "7" (e.g., the pips on the dice total "7") on a pair of dice. In this example, other dice rolls may provide the slot game enhancements 108. For example, obtaining a roll of "2" may provide a first slot game enhancement, while a roll of "3" may provide the same or a different slot game enhancement. In one embodiment, each of the possible rolls of the dice is defined to provide either some slot game enhancement or an end to providing the slot game enhancements. In other embodiments, one or more rolls of the die/dice may provide no enhancement or identify an end to providing such enhancements.

Where no terminating roll 114 has occurred, the die/dice roll repeats such that the provided slot game enhancements 108 can be accumulated 110. For example, where the slot game enhancement represents a multiplier (e.g., particular multiplier values corresponding to particular die/dice results), the multiplier values may be accumulated by adding, multiplying, or otherwise mathematically manipulating the provided multipliers. In such an embodiment, the accumulation 110 may be implemented by storing the provided 108 multipliers, and adding the multipliers together to arrive at an accumulated multiplier (or simply adding newly acquired multipliers to a running total), which may again be stored in a memory or other storage component. For example, with four die/dice rolls before obtaining a terminating roll 114, the provided multipliers may be 2×, 3×, 3× and 5×, resulting in an accumulated slot game enhancement of 13× (e.g., 2×+3×+3×+5×=13×). In one embodiment, when a terminating roll 114 occurs, the accumulated multiplier is then applied 117 to the slot/video game 100. For example, in one embodiment, the accumulated multiplier is applied to the player's total wager, such that if the player had wagered ten credits, the total award would be one-hundred-thirty credits where the accumulated slot game enhancement was a 13× multiplier.

In another example, the slot game enhancement may represent a free play/spin award. Such an award enables the player to "spin the reels" or otherwise engage in another gaming event of the game 100. In such an embodiment, where no terminating roll 114 has occurred, the die/dice roll repeats such that the provided free slot game enhancements 108 (i.e., free spins/plays in this example) can be accumulated 110 by adding, multiplying, or otherwise mathematically manipulating the provided number of free spins/plays. In one embodiment, the accumulation 110 of such free plays may be implemented by adding the provided 108 free plays to a running total of free plays. For example, a free play meter may be provided via a user interface by which the player can be aware of the current number of free plays available, where the accumulation 110 of such free plays increases as the player is provided 108 with more free plays and decreases as the player expends the free plays. In one embodiment, this accumulated number of slot game enhancements 110 is immediately applied 117 to the slot/video game 100 to enable the player to expend the free spins. In one embodiment, when the terminating roll 114 has occurred, no further free spins will be awarded 108, but the player may expend the accumulated total 110 until no free spins remain.

Figure 2:
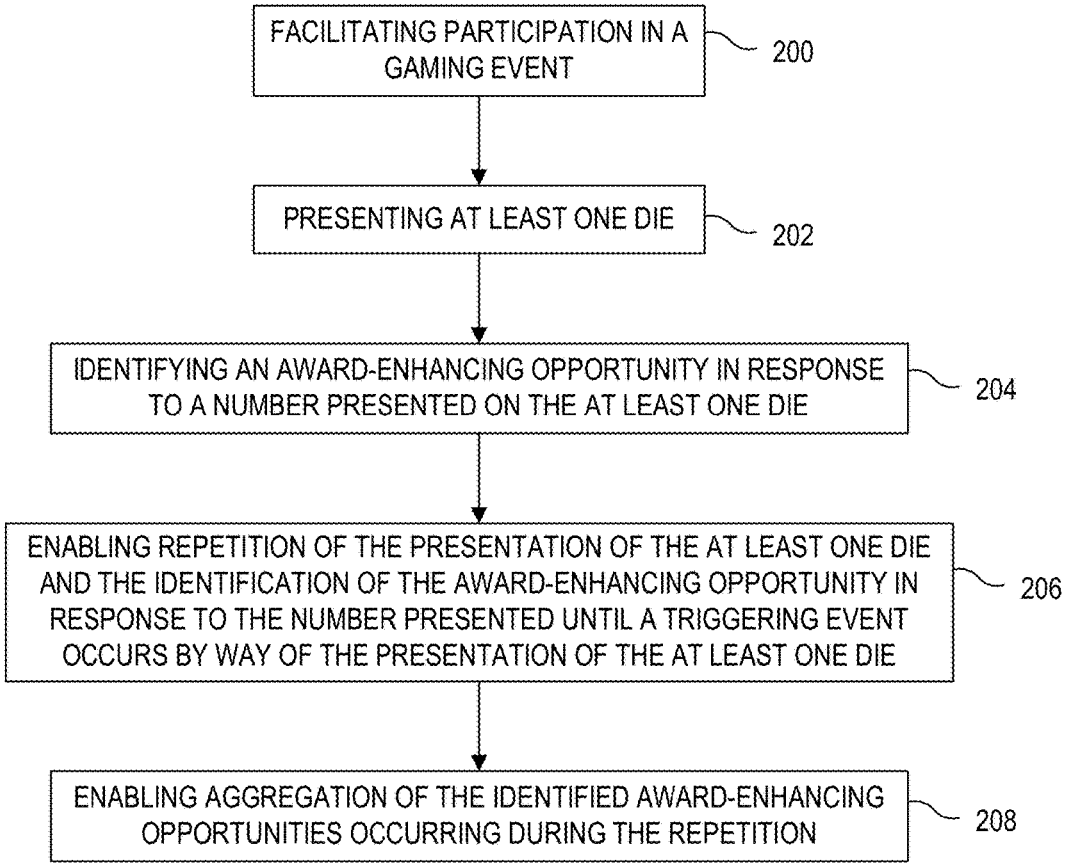
FIG. 2 is a flow diagram illustrating a representative method for providing award-enhancing opportunities using a die/dice.

FIG. 2 is a flow diagram illustrating a representative embodiment. Participation in a gaming event is facilitated 200. For example, a user interface including one or both of a user input interface and an output interface (e.g., display, audio, etc.) may be provided to enable the player access to the underlying gaming event. At least one die is presented 202, and an award-enhancing opportunity is identified 204 in response to a number presented on the die/dice. As shown at block 204, the representative method involves facilitating repetition of the presentation of the die/dice and the identification of the award-enhancing opportunity in response to the number presented on the die/dice, until a triggering event occurs by way of the presentation of the die/dice. Aggregation of the identified award-enhancing opportunities occurring during the repetition is facilitated 206. In one embodiment, payout opportunities relative to the participation in the gaming event are enhanced using the aggregation of the identified award-enhancing opportunities.

In one embodiment, the facilitated gaming event 200 is a slot game. In one embodiment the various functions 202-208 are triggered as a gaming feature upon occurrence of some triggering event(s) occurring during participation in the slot game, although the functions 202-208 may be provided at any time and/or based on any rules. The gaming event 200 is an entirely different gaming event than the functions 202-208 in some embodiments, such as where the gaming event is symbol-based slot game and the functions 202-208 involve the dice roll feature. The presentation 202 of the die/dice may be, for example, a visual and/or audio presentation of the number of pips presented on a single die or the total number of pips presented on multiple dice. Other "dice" may simply include a number or other numeric indicator on each face that form another number or total another number. The die/dice may be visually presented in any desired manner, such as by way of an electronic display, by way of mechanical moving die/dice, actual die/dice, etc.

Identifying the award-enhancing opportunity 204 may involve, for example, identifying a multiplier value corresponding to the number presented on the die/dice. In such an embodiment, enabling or otherwise facilitating aggregation of the identified award-enhancing opportunities 208 may involve enabling the identified multiplier values to be added into an accumulated multiplier during the repetition. In one related embodiment, the accumulated multiplier value may be multiplied times a wager placed in the gaming event. In an alternative representative embodiment, the accumulated multiplier value may be multiplied by a payout or other award provided during participation in the gaming event.

Other representative embodiments involve free plays. In one example of such an embodiment, identifying the award-enhancing opportunity 204 involves determining the number of free plays based on what number is presented on the die/dice. Such free plays may be applied to the gaming event; e.g., the player may obtain free spins in the gaming event that triggered the dice feature. In such an embodiment, enabling aggregation of the identified award-enhancing opportunities 208 may involve enabling, during the repetition, the identified number of free plays to be added to a current number of free plays available in the gaming event. Multipliers and free plays merely represent examples of award-enhancing opportunities capable of use in connection with the principles described herein.

In one representative embodiment, enabling repetition 206 involves enabling repetition of the presentation of the die/dice and the identification of the award-enhancing opportunity in response to the number presented on the die/dice being any one of a first set of results (e.g., any of a 2, 3, 4, 5, 6, 8, 9, 10, 11 and 12), and disallowing further repetition in response to the number presented on the die/dice being any one of a second set of results (e.g., a 7). These are merely examples of how repetition may be determined based on the state of the presented die/dice.

In other embodiments, some number of repetitions 206 may be guaranteed, and one or more further repetitions may be conditional on the state of the rolled die/dice. Examples of such embodiments are described in further detail below.

Figure 3:
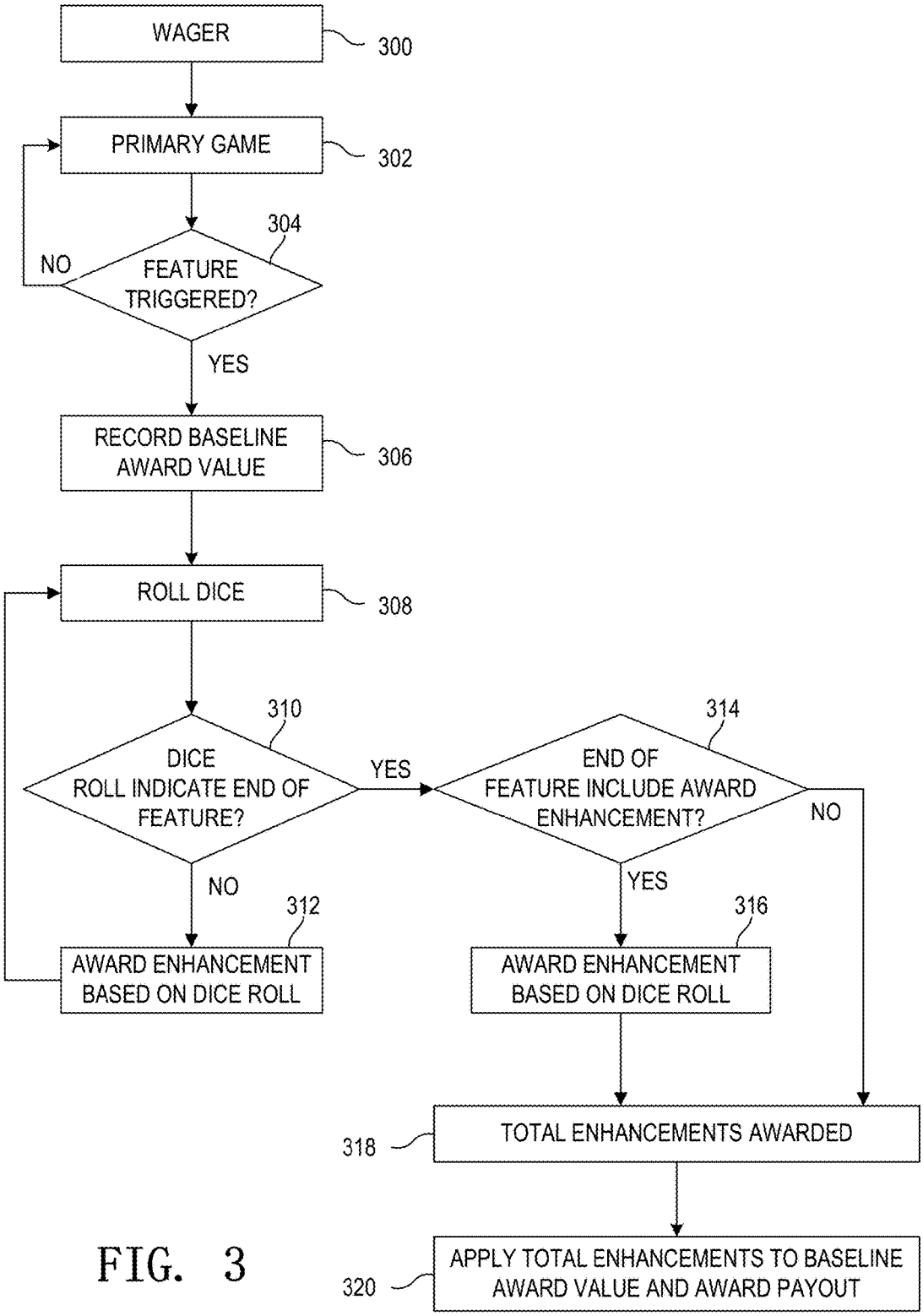
FIG. 3 is a flow diagram of a representative embodiment in which award opportunities in a primary game are enhanced using a die/dice.

FIG. 3 is a flow diagram of another representative embodiment in which award opportunities are enhanced. This embodiment assumes a wager-based game, such as a slot game requiring player wagers 300 in which to participate. This embodiment also assumes that a native or primary game 302 is operable on the slot machine, where the dice feature may be triggered by something occurring during participation in the primary game. If the feature is not triggered 304, facilitation of participation in the primary game continues. If, however, the feature is triggered 304, participation in the dice roll feature is enabled. For example, obtaining the requisite symbols in the primary game based on rules may trigger the feature. In the illustrated embodiment, when the feature is triggered 304, a baseline award value may be recorded 306. This baseline award may be, for example, a number of free spins already available to the player, the total wager placed by the player for that particular slot event (e.g., for that "spin" of the reels), the payout obtained for that particular slot event, or any other baseline award to which the award-enhancing opportunity is to be applied. A die/dice result is presented 308, which is generally referred to herein as "rolling the dice." If, as determined at decision block 310, the dice roll does not indicate that the feature is to end, then an award enhancement is provided 312 based on that dice roll. However, as previously noted, some embodiments disregard a dice roll indicating the end of feature, and optionally provide 312 an award enhancement, up to the Nth occurrence of that terminating dice roll. For example, where N=1, the feature is not terminated on the first occurrence of the terminating dice roll, but will be terminated on the second occurrence of that terminating dice roll.

Where block 312 is reached, the dice may then be rolled 308 again, and the process 308, 310, 312 may continue until the dice roll indicates 310 the end of the feature. In such case, one embodiment may still provide an award for that dice roll, even though the dice roll indicated that the feature is to end. This is depicted by determining 314 if the end of feature roll includes an award enhancement. If so, the enhancement is awarded 316 based on the dice roll; else no further enhancement is provided. In either case, the total enhancements awarded 318 is determined, which represents an accumulation of the awards 312, and possibly 316, that were provided during participation in the feature. In one embodiment the total enhancements 318 are applied 320 to the previously recorded baseline 306, and a payout may be provided.

Figure 4:
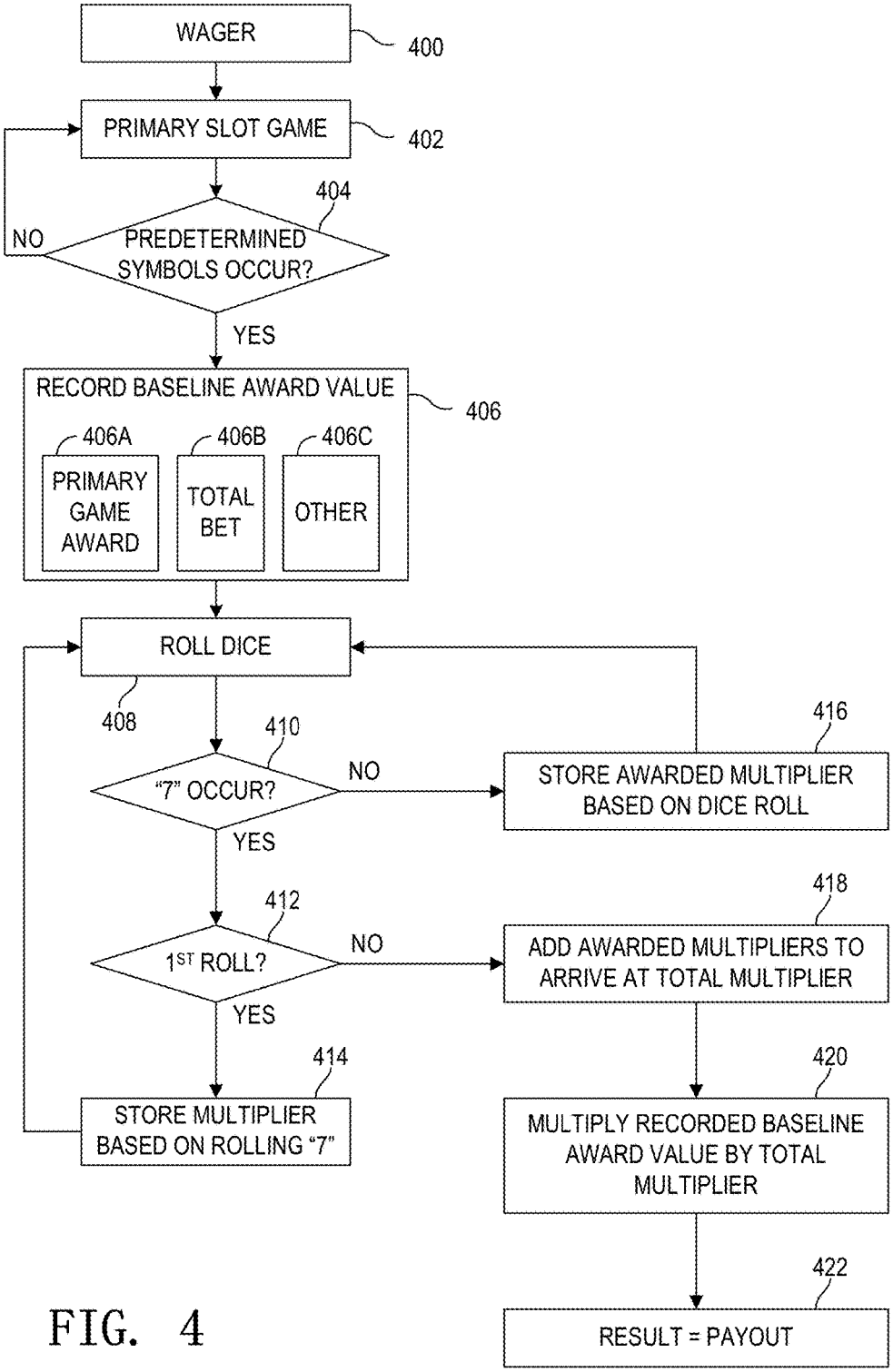
FIG. 4 is a flow diagram of a representative embodiment in which award opportunities in a primary game are enhanced with multipliers.

FIG. 4 is a flow diagram of another representative embodiment in which award opportunities are enhanced. This embodiment again assumes a wager-based game, such as a slot game requiring player wagers 400 in which to participate. This embodiment also assumes that a native or primary game 402 is operable on the slot machine, where the dice feature is triggered upon the occurrence of predetermined symbol(s) or a predetermined symbol combination occurring as determined at block 404. If the predetermined symbol(s) or combination does not occur, participation in the primary game continues. If the predetermined symbol(s) or combination occurs, participation in the dice roll feature is enabled. In the illustrated embodiment, a baseline award value is recorded 406, which may represent a primary game award 406A, total bet 406B or other 406C baseline value. Other 406C exemplary baseline values may be a fixed or random baseline value or based on other rules.

The dice faces are presented 408, such as by a visualization of the dice being rolled. In the embodiment of FIG. 4, a set of rules are applied to identify multiplier values and termination events based on the state of the rolled dice. FIG. 5 is a table showing a representative embodiment involving termination values and multiplier values as the award-enhancing opportunities. It should be recognized that "tables" described herein, such as the table of FIG. 5, are shown for purposes of example and are not intended to suggest a particular data structure unless otherwise noted (although table data structures may be utilized). Referring to FIG. 5, particular dice rolls 500 (assuming two dice in this embodiment) are correlated to multiplier values and termination conditions 502. Particularly, correlating row 504 indicates that a roll of "2" (e.g., one pip on each of two standard dice or virtual dice) provides a multiplier value of "10." A multiplier of 10× is also provided for a roll of "12" as noted at row 506. As can be seen in the example of FIG. 5, different dice rolls may produce different multiplier values. Further, in the example of FIG. 5 a dice roll of "7" has additional rules that are further described in connection with FIG. 4.

Referring now to FIGS. 4 and 5, it is determined 410 whether a "7" has been rolled. If so, it is determined 412 whether it is the first time that a "7" has been rolled during participation of this instance of the feature. If so, it does not represent a feature-terminating event, although it would otherwise. As shown at row 508 of FIG. 5, if the first roll results in a "7," a 7× multiplier is awarded in this embodiment. After the first roll, rolling a "7" ends the award-enhancing feature, and no further awards are accumulated. This is depicted in FIG. 4, where a multiplier is stored 414 based on rolling a "7" if the roll was determined 412 to be the first roll. In this case, the player is allowed to continue to roll the dice 408, and the process continues.

If a "7" is not rolled as determined at decision block 410, then one of the multipliers shown in FIG. 5 is awarded, which may be stored 416, and the player is again allowed to roll the dice 408. In this particular example, if any of a 2, 3, 4, 5, 6, 8, 9, 10, 11 or 12 is rolled, some corresponding multiplier value is awarded. This continues until the player rolls a "7" on any roll beyond the first roll, as determined at decision blocks 410 and 412. In the illustrated embodiment, no further multiplier is awarded when a "7" is rolled beyond the first roll, but an award may be provided with the terminating roll. In the illustrated embodiment, the multipliers obtained at blocks 414 and/or 416 are added together 418 to arrive at a total multiplier award. This provides an award-enhancing opportunity, such as where the baseline award value is a non-zero value that can be increased through multiplication. The recorded baseline award value is multiplied 420 by the total multiplier, which results in an enhanced payout 422.

It should be noted that the storing of multipliers at 414, 416 and ultimate adding 418 of the multipliers is depicted in this fashion for purposes of illustration. However, any manner of accumulating the multipliers may be implemented. For example, rather than storing the specific multipliers at blocks 414, 416 and adding 418, the accumulation can be implemented by storing a running count of the current accumulated value. For example, a multiplier of "3×" may be stored as a running count, and another multiplier of "4×" may be awarded such that the running count is increased to "7×." Thus, the particular representation in FIG. 4 for identifying the accumulated award-enhancing opportunity should not be seen as limiting, but rather merely as an example of an accumulation technique.

Figure 6:
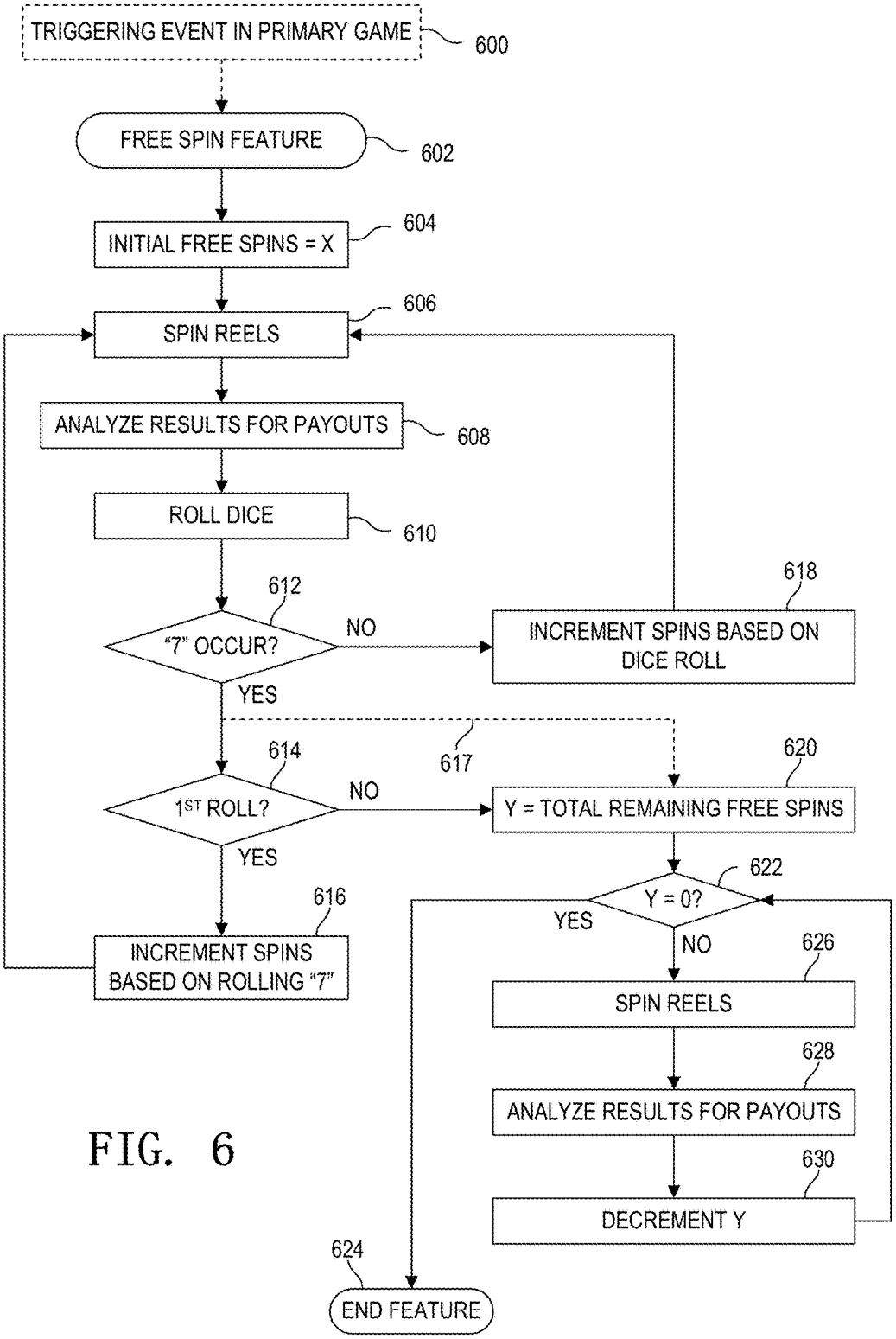
FIG. 6 is a flow diagram of a representative embodiment in which award opportunities in a primary game are enhanced with additional plays of the gaming event.

FIG. 6 is a flow diagram of another representative embodiment in which award opportunities are enhanced. As will be described in more detail below, this embodiment involves an award-enhancing opportunity in the form of additional opportunities to win payouts in a primary game, and more particularly in the form of free plays (or "free spins" in the context of symbol-based mechanical or virtual reel slot games). As in other embodiments, this embodiment may or may not involve a player wager.

In the embodiment of FIG. 6, a free spin feature 602 is provided, which may optionally be triggered 600 from the primary game. When entering the free spin feature 602, the player may or may not already have accumulated some free spins. This is depicted by block 604, where the number of initial free spins is currently at "x," where x in one embodiment can represent any number between zero and some positive integer. For example, in the event that the free spin feature 602 is the only manner in which a player can obtain free spins, then the number of initial free spins may be zero. On the other hand, the player may have currently or previously won free spins that can be utilized in the free spin feature 602.

Block 606 indicates "spin reels," which in one embodiment represents randomly presenting symbols in the primary slot game. The results are analyzed 608 for payouts, either presently or recorded for payout at a later time. One or more dice are then rolled 610 as previously described. For purposes of example, the embodiment of FIG. 6 assumes that two dice are presented, and a set of rules are applied to identify free spin values and termination events based on the state of the rolled dice. FIG. 7 is a table showing a representative embodiment involving termination values and free spin quantities as the award-enhancing opportunities. In FIG. 7 particular dice rolls 700 are correlated to free spin quantities and termination conditions 702. Particularly, correlating rows 704 and 706 indicate that dice presentations of "2" and "12" each provide ten free spins, rows 708 and 710 indicate that dice presentations of "3" and "11" each provide five free spins, and so forth. Further, in the example of FIG. 7 a dice roll of "7" has additional rules that are further described in connection with FIG. 6.

Referring now to FIGS. 6 and 7, it is determined 612 whether a "7" has been rolled. If so, it is determined 614 whether it is the first time that a "7" has been rolled during participation of this instance of the feature. If so, it does not represent a feature-terminating event, although it would otherwise. As shown at row 712 of FIG. 7, if the first roll results in a "7," seven free spins are awarded in this embodiment. After the first roll, rolling a "7" ends the award-enhancing feature, and no further awards are accumulated in this embodiment. This is depicted in FIG. 6, where the number of free spins available to the player is incremented 616 based on rolling a "7" if the roll was determined 614 to be the first roll. In this case, the player is allowed to continue to spin the reels 606 and roll the dice 610, and the process continues. It should be noted that some embodiments do not allow for rolling the terminating number some number of times before it becomes a terminating event, such as depicted by line 617 which terminates the potentially repeating dice rolling process.

If a "7" is not rolled as determined at decision block 612, then one of the free spin quantities shown in FIG. 7 is awarded, which results in incrementing 618 the number of spins available to the player. In this case, the player is allowed to continue to spin the reels 606 and roll the dice 610. In this particular example, if any of a 2, 3, 4, 5, 6, 8, 9, 10, 11 or 12 is rolled, some corresponding number of free spins is awarded. In this embodiment, this continues until the player rolls a "7" on any roll beyond the first roll, as determined at decision blocks 612 and 614. In the illustrated embodiment, no further free spins are awarded when a "7" is rolled beyond the first roll, and an award may or may not be provided with the terminating roll. In any event, there may be a number (e.g., "Y") of total remaining free spins 620 at the time the terminating dice roll occurs. If no free spins are remaining as determined at decision block 622 (i.e., Y=0 in this example), then the feature ends 624. Otherwise, the reels are spun 626 again, and the results are analyzed 628 for payouts. This continues until there are no remaining free spins. A depiction of continuing the free spins 626 and analyzing the results 628 until there are no further free spins is provided by decrementing 630 the count value "Y" until Y=0 as determined at block 622. It should be noted that the description of such a variable "Y" and decrementing such count is provided for purposes of illustration, and is not intended to suggest the only way to determine when the free spin count has reached zero.

Figure 8:
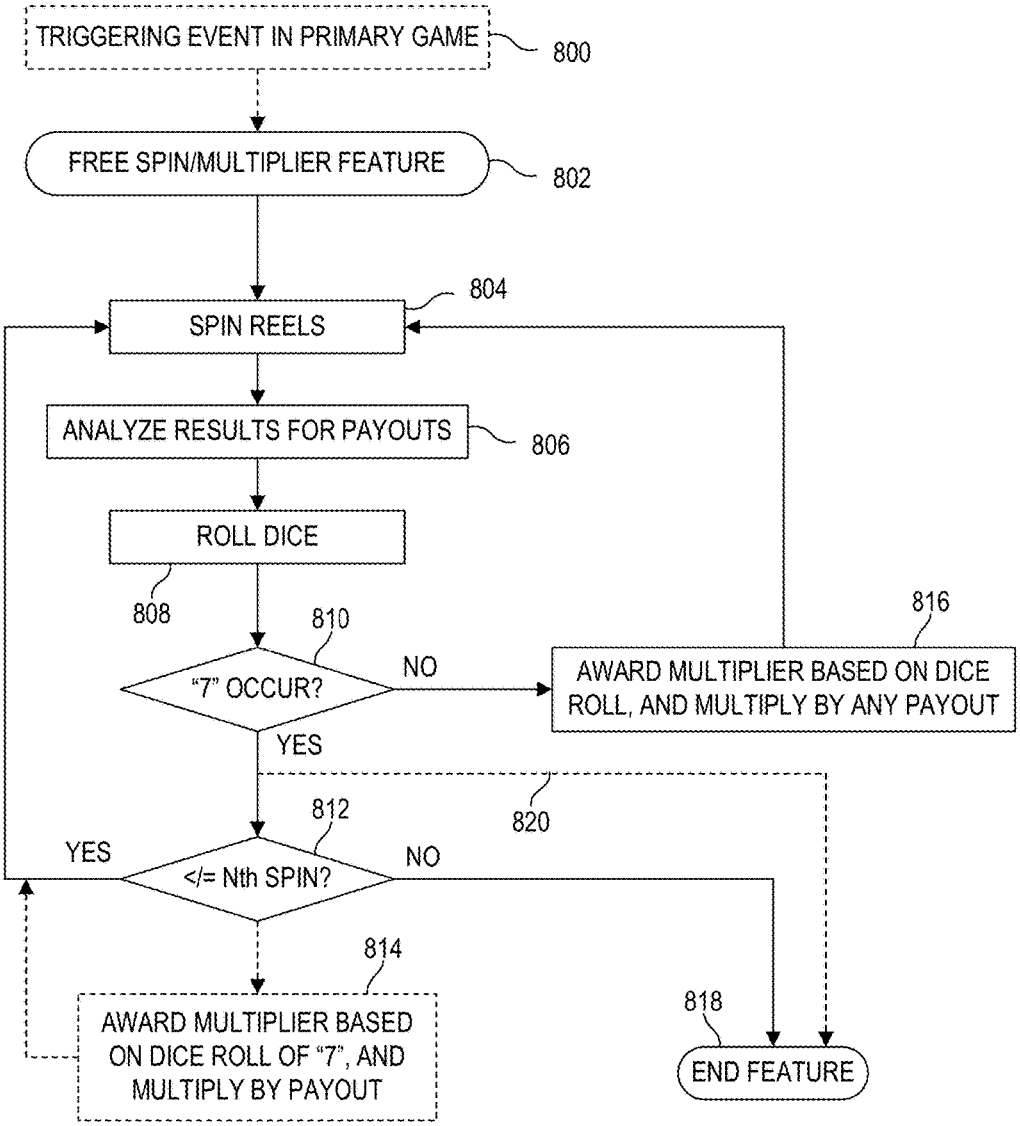
FIG. 8 is a flow diagram of a representative embodiment in which award opportunities in a primary game are enhanced with mathematical augmentation and additional plays of the gaming event.

FIG. 8 is a flow diagram of another representative embodiment in which award opportunities are enhanced. As will be described in more detail below, this embodiment involves an award-enhancing opportunity in the form of additional opportunities to win payouts in a primary game, such as free plays, as well as additional opportunities to increase the amount of payouts.

In the embodiment of FIG. 8, a free spin and multiplier feature 802 is provided, which may optionally be triggered 800 from the primary game. When entering the feature 802, the player may or may not already have accumulated some free spins as described in connection with FIG. 6. Block 804 indicates "spin reels," which in one embodiment represents randomly presenting symbols in the primary slot game. The results are analyzed 806 for payouts, either presently or recorded for payout at a later time. One or more dice are then rolled 808 as previously described. For purposes of example, the embodiment of FIG. 8 assumes that two dice are presented, and a set of rules are applied to identify termination events and multiplier values for some number of free spins based on the state of the rolled dice.

Figure 9:
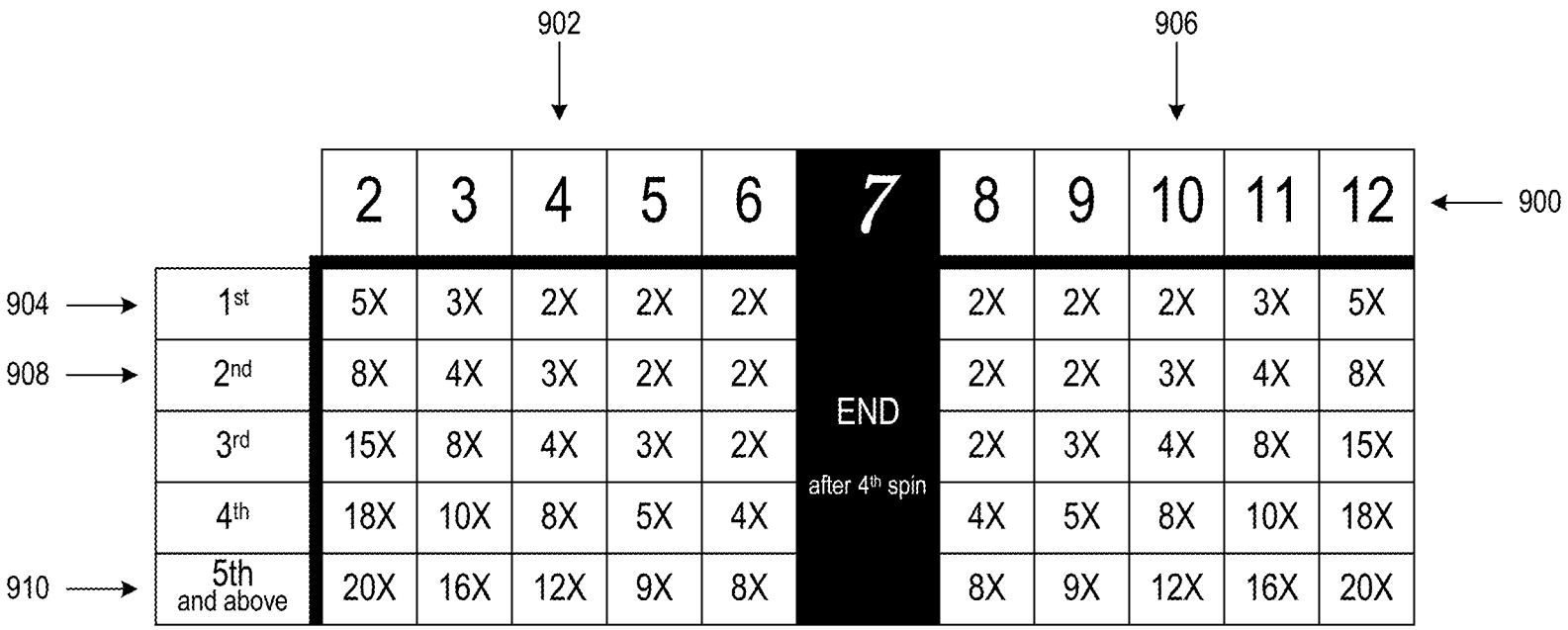
FIG. 9 illustrates a representative correlation between dice roll results and their impact on payouts of the gaming event through mathematical augmentation and increased opportunities in a primary gaming event.

Referring now to FIG. 9, a table illustrates a representative embodiment involving termination values and multipliers for a number of free spins as the award-enhancing opportunities. In FIG. 9 particular dice rolls 900 are correlated to multiplier values that depend on which roll of the dice has occurred. In one embodiment, it is assumed that some number of free spins and respective dice rolls are guaranteed. For example, in the embodiment of FIG. 9, it is assumed that four free spins are guaranteed to the player, and occurrence of a particular value(s) on the dice will end the feature on the fifth roll or higher. In the example of FIG. 9, if a "4" 902 is rolled on the first roll 904, the player is awarded with a 2× multiplier. In one embodiment this multiplier is used to increase a payout obtained by the player on that particular spin of the reels, although other embodiments may allow for multiplier accumulation as previously described. If a "10" 906 is rolled on the second roll 908, the player is awarded with a 3× multiplier that may be used to increase any payout obtained by the player on that particular spin. According to the rule set of FIG. 9, if a "7" is rolled in the first "N" rolls (where N=4 in the embodiments of FIGS. 8 and 9), the feature does not end, and a multiplier may or may not be awarded for rolling this established dice value(s). However, on the $5^{th}$ spin 910 and corresponding dice roll, or any spin after the $5^{th}$ spin, rolling a "7" will end the feature.

Referring now to FIGS. 8 and 9, it is determined 810 whether a "7" has been rolled. If so, it is determined 812 whether it is one of the first "N" spins, such as where N=4 in the embodiment of FIG. 9. If so, then the "7" is not a terminating event, and a multiplier may optionally be awarded 814 based on a multiplier associated with a dice roll of "7." In the embodiment of FIG. 9, no such multiplier value is associated with rolling a "7." Where the "7" is rolled in the first "N" rolls, the feature does not end, and the reels can again be spun 804.

If a "7" is not rolled as determined at block 810, the multiplier associated with that dice roll is awarded 816. In the embodiment of FIG. 9, the multiplier is dependent on both the dice rolled, and which spin and associated dice roll has occurred. The multiplier may be used in increase any payout provided during the particular spin 804, or alternatively may be accumulated in some fashion. As a terminating dice roll did not occur, the reels can again be spun 804, and the process is repeated. In the illustrated embodiment, the spinning of reels 804 and rolling of dice 808 is repeated until a terminating dice roll of "7" occurs on the $5^{th}$ or subsequent spin 804, at which time the feature ends 818. It should be noted that other embodiments do not involve any guaranteed number of spins, resulting in ending 818 the feature upon a dice roll of "7" as depicted by line 820.

Figure 10:
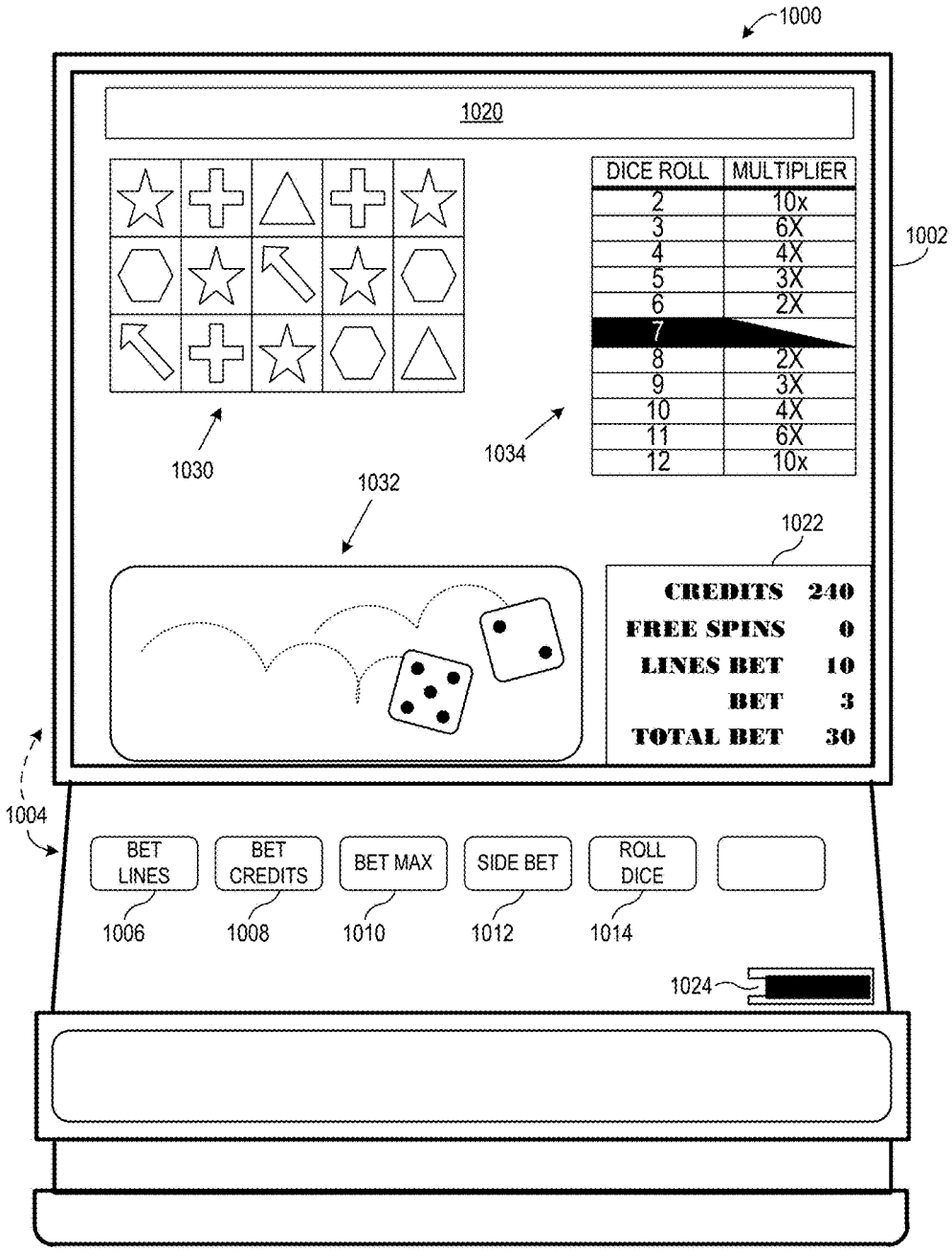
FIG. 10 illustrates a representative embodiment of a casino-style gaming device in which the principles of the present invention may be implemented.

The embodiments described herein may be implemented on computing systems, mechanical or electronic slot machines or other gaming kiosks, hand-held gaming devices, and the like. FIG. 10 illustrates a representative embodiment of a casino-style gaming device in which the gaming features described herein may be applied. While the description of the gaming device is FIG. 10 is provided in terms of a slot machine or similar gaming kiosk, any computer-based system is applicable.

The illustrated gaming machine 1000 includes a computing system (not shown) to carry out operations according to the invention. The illustrated gaming machine 1000 includes a display 1002, and a user interface 1004, although some or all of the user interface 1004 may be provided via the display 1002 in touch screen embodiments.

The user interface 1004 allows the user to control and engage in play of the gaming machine 1000. The particular user interface mechanisms associated with user interface 1004 is dependent on the type of gaming machine. For example, the user interface 1004 may include one or more buttons, switches, joysticks, levers, pull-down handles, trackballs, voice-activated input, or any other user input system or mechanism that allows the user to play the particular gaming activity. The user interface 1004 may allow the user to enter coins, bills, or otherwise obtain credits through vouchers, tokens, credit cards, tickets, etc. Various mechanisms for entering such vouchers, tokens, credit cards, coins, tickets, etc. are known in the art. For example, coin/token input mechanisms, card readers, credit card readers, smart card readers, punch card readers, and other mechanisms may be used to enter wagers. It is through the user interface 1004 that the user can initiate and engage in gaming activities involving embodiments described herein. For example, the user can use the user interface 1004 and/or touch screen inputs to bet 1006 on a number of items/paylines, bet 1008 a number of credits per item/payline wagered, make gaming decisions such as place a maximum wager 1010 or place secondary or side bets 1012, initiate when the die/dice will be rolled 1014, etc. For example, in one embodiment, the user may be eligible for the roll dice feature described herein when placing a maximum wager, or placing a side bet, or other condition for eligibility. In other embodiments, there is no such eligibility, and the player may be eligible to receive the roll dice feature in the normal course of participating in the gaming event, which may or may not be based on rules indicating when the roll dice feature will be presented to the player. While the illustrated embodiment of FIG. 10 depicts various "buttons" for the user interface 1004, it should be recognized that a wide variety of user interface options are available for use in connection with the present invention, including pressing buttons, touching a segment of a touch-screen, entering text, entering voice commands, or other known user entry methodology.

The display device 1002 may include one or more of an electronic display, a mechanical display, and fixed display information such as information such as paytable information associated with a glass/plastic panel 1020 on the gaming machine 1000. A display segment or panel 1022 may also be provided to display information such as the accumulated credits, free spin "meter," number of lines wagered, current bet amount such as "3" credits (where credits may represent, for example, coins, tokens, dollars, etc.), the total wager for all lines/credits at play, multiplier values such as a running total of multipliers received through the dice feature described herein, the number of credits paid out or "won" on a particular play, etc. A wager acceptor 1024 is operative to receive wager tokens, coins, bills, credit/debit cards, coupons, smart cards, prepaid casino cards, electronic fund transfer (EFT), tickets, and the like.

In the illustrated embodiment, the gaming machine is involved in a gaming event 1030 that may represent the primary or native gaming event in which the player is participating. In this embodiment, the gaming event 1030 is depicted to be a slot game, where symbols are indicative of whether a player receives a payout based on, for example, symbol presentation and/or symbol combination rules. As previously described, embodiments described herein involve a roll dice feature that is depicted at display area 1032 where the resulting state of the dice may be presented (although audio and/or other manners of notifying the player of the resulting dice roll may instead or additionally used). Depending on the embodiment, a table 1034 or other potential award notification area may be provided to enable the participant to know the results of the dice roll feature during participation in the feature and/or after the feature has concluded.

Figure 11:
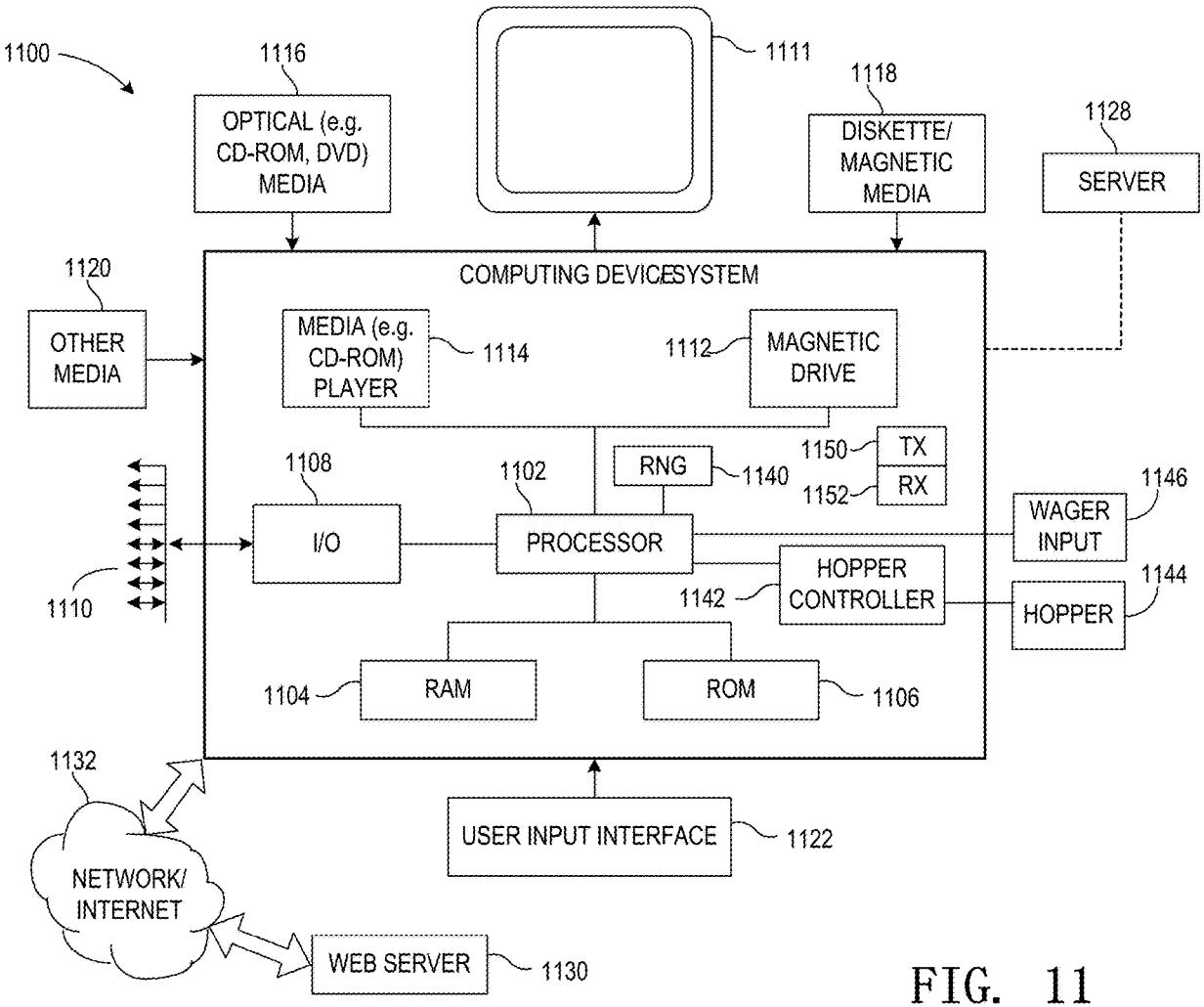
FIG. 11 illustrates representative computing components capable of carrying out operations described herein.

As may now be readily understood, the device 1000 may be programmed to facilitate the embodiments of the invention. The invention may be implemented as a casino gaming machine such as a slot machine, video gaming machine or other special purpose gaming kiosk as described in FIG. 10, or may be implemented via computing systems operating under the direction of local gaming software, and/or remotely-provided software such as provided by an application service provider (ASP). The casino gaming machine utilizes a computing system to control and manage the gaming activity. An example of a representative computing system capable of carrying out operations in accordance with the invention is illustrated in FIG. 11.

Hardware, firmware, software or a combination thereof may be used to perform the various gaming functions, display presentations and operations described herein. The functional modules used in connection with the invention may reside in a gaming machine as described, or may alternatively reside on a stand-alone or networked computing device/system. The computing structure 1100 of FIG. 11 is an exemplary computing structure that can be used in connection with such electronic gaming machines, computers, or other computer-implemented devices to carry out operations of the present invention. It should be noted that the representative computing structure of FIG. 11 or analogous computing structure may be used on a local computer, kiosk, server, or any other device providing or serving the gaming functions. It should also be noted that the computing arrangement of FIG. 11 may be distributed across multiple devices (e.g., processing components at a server, and display and user interface components at a local gaming machine, etc.).

The example computing arrangement 1100 suitable for performing the gaming functions in accordance with the invention typically includes a processor (e.g., CPU) 1102, which may be coupled to volatile memory such as random access memory (RAM) 1104 and some variation of read-only memory (ROM) 1106. The depicted ROM 1106 may also represent other types of storage media to store programs, such as programmable ROM (PROM), erasable PROM (EPROM), and other non-volatile memory or storage. The processor 1102 may communicate with other internal and external components through input/output (I/O) circuitry 1108 and bussing 1110, to provide control signals, communication signals, and the like.

The chance-based gaming systems such as slot machines may be governed by random numbers and/or processors. A display device 1111 is used to display the gaming activity as facilitated by one or more random number generators (RNG). RNGs may be implemented using hardware, software operable in connection with the processor 1102, or some combination of hardware and software. The embodiments described herein and their equivalents are operable using any known RNG, and may be integrally programmed as part of the processor 1102 operation, or alternatively may be a separate RNG controller 1140.

The computing arrangement 1100 may also include one or more media read and/or write devices, such as hard and floppy disk drives 1112, optical drives 1114 (e.g., CD-ROM, DVD, etc.), and other hardware capable of reading and/or storing information such as FLASH and other solid state storage devices, etc. In one embodiment, software for carrying out the operations in accordance with the invention may be stored and distributed on optical media 1116 such as CD-ROM and DVD, magnetic media such as hard disks or diskette 1118, FLASH and other solid state storage or other form of media 1120 capable of storing information. These storage media may be inserted into, and read by, devices such as the optical drive 1114, the magnetic drive 1112, hardware receptacles for portable media, etc. The software may also be transmitted to the computing arrangement 1100 via data signals, such as being downloaded electronically via a network, such as the Internet. Further, as previously described, the software for carrying out the functions associated with the present invention may alternatively be stored in internal memory/storage of the computing device 1100, such as in RAM 1104, ROM 1106, or other storage.

The computing arrangement 1100 is coupled to the display(s) 1111, which represents a display on which the gaming activities are presented. The display 1111 may be any type of known display or presentation screen, such as LCD displays, plasma display, cathode ray tubes (CRT), etc. Where the computing device 1100 represents a stand-alone or networked computer, the display 1111 may represent a standard computer terminal or display, which may also be capable of displaying multiple windows, frames, etc. Where the computing device is embedded within an electronic gaming machine (see FIG. 10), the display(s) 1111 corresponds to the display screen(s) of the gaming machine/kiosk. A user input interface 1122 such as a mouse, buttons, keyboard/keypad, microphone, touch pad, trackball, joystick, touch screen, voice-recognition system, etc. may be provided.

The computing arrangement 1100 may be connected to other computing devices or gaming machines, such as via a network(s). The computing arrangement 1100 may be connected to a network server 1128 in an intranet or local network configuration. The computer may further be part of a larger network configuration as in a global area network (GAN) such as the Internet. In such a case, the computer accesses one or more web servers 1130 via the network/Internet 1132.

Other components directed to gaming machine implementations include manners of gaming participant payment, and gaming machine payout. For example, a gaming machine including the computing arrangement 1100 may also include a hopper controller 1142 to determine the amount of payout to be provided to the participant. The hopper controller may be integrally implemented with the processor 1102, or alternatively as a separate hopper controller 1142. A hopper 1144 may also be provided in gaming machine embodiments, where the hopper serves as the mechanism holding the coins/tokens of the machine. The wager input module 1146 represents any mechanism for accepting coins, tokens, coupons, bills, electronic fund transfer (EFT), tickets, credit cards, smart cards, membership cards, etc., for which a participant inputs a wager amount.

Additionally, the computing arrangement 1100 may include a transmitter (TX) 1150, and may include a receiver (RX) 1152. These TX 1150 and RX 1152 components may be discrete components, or aggregated such as in the case of a transceiver. The receiver function provided by the RX 1152 can be configured to receive information from any type of network, such as a local area network (LAN), wireless LAN (e.g., 802.11a/b/g), wired network (e.g., Internet), wireless network (e.g., Global System for Mobile Communications/General Packet Radio Service (GSM/GPRS), proximity networks (e.g., Bluetooth, peer-to-peer networks), and/or other wired/wireless network technologies. For example, the RX 1152 may receive programming and/or operational information from a server 1128 or 1130 where the system is server-based. Any such server may include computing components analogous to those depicted in FIG. 11. Information such as wager information or other data used by a server can be provided to the appropriate server 1128, 1130 or other device or network entity via the TX 1150.

It should also be recognized that the computing arrangement 1100 of FIG. 11 may be implemented in a gaming apparatus, and/or in a server or other network entity that determines and provides features in accordance with the invention.

The gaming apparatuses and methods described herein may be implemented with any number of features, including group or community participation, inclusion of progressive awards, various game exceptions to die rolling rules, and the like. Some representative variations are now described.

In one embodiment of gaming events involving award-enhancing opportunities using a die/dice, rule exceptions, rule overrides and/or other rule variations may be employed to provide further excitement to the gaming activity. For example, a "safe 7s" variation may allow the player(s) to continue playing even if the normal rules would terminate the dice event where a player has rolled a "7." Examples of events that could override a rule such as terminating the die/dice event when a "7" is rolled are now described.

In a first example, rolling predetermined dice combinations could present a "life-saver" that prevents a bonus or other gaming activity from ending when a "7" is rolled with two dice. Examples of such dice combinations include "hardways," such as (1-1), (2-2), (3-3), (4-4), (5-5) and (6-6) on a pair of dice. Such a feature that negates a termination event (e.g. rolling a "7") may be mapped to particular hardway numbers. For example, rolling a hard two (1-1) could grant the player two "life-savers" to be used to keep the player safe when the next two "7s" appear, whereas a hard four (2-2) might grant the player only one "life-saver." In another embodiment, such life-savers may be duration based, such as where rolling a hard two (1-1) could grant the player safety against a "7" being a terminating event for the next two rolls. In still another embodiment, life-savers may be applied to certain dice combinations of the terminating roll (e.g. rolling a "7"), such as a (3-4) roll versus a (2-5) or (1-6) roll.

In another example, such life-saver feature(s) that negates an otherwise terminating event (e.g. rolling a "7") may be randomly determined as active on particular rolls. For example, life-savers could be randomly generated before each spin of a slot game, a weighted table could be used to determine the presence of a life-saver on each roll or series of rolls, etc.

In another example, rolling a particular order or series of numbers could invoke a life-saver(s). For example, rolling three sixes in a row could grant a life saver for a certain duration or until some other triggering event occurs. In another embodiment, a life-saver(s) could be obtained by rolling a group or segment of numbers, such as by rolling some or all ways to obtain any number other than "7" (e.g. 1-1, 1-2, 1-3, 1-4, 1-5, 2-1, 2-2, etc.).

In yet another example, rolling certain numbers may toggle a state of whether a safe roll is present or not. For example, the first time a number is rolled, that number may change color (e.g. green) or otherwise be designated as a "safe state," such that if a "7" or other normally terminating event were to occur, the dice rolling event would not be terminated. If that number is rolled again, it might then toggle to an "unsafe state" where rolling the "7" would terminate the event. An unsafe state may be designated in a particular way, such as changing to a different color (e.g. red). Any one or more numbers could be declared as the numbers to toggle between at least the states of safe and unsafe. For example, the set of numbers 4, 5, 6 and 8 may be designated as the toggling numbers. If the player were to roll one "4," one "5," one "6," and one "8" in a given session or gaming event, the safe state may be activated. If the player rolled any of those numbers in the set, such as another "4," the state may return to the unsafe state where rolling a "7" (or other terminating roll) can terminate the session/gaming event. If the player again rolls a "4," the safe state could be turned back on, and so forth. Any numbers or group of numbers could be eligible for toggling the safe state.

In another example, a random number(s) may be determined on each roll of the dice or certain rolls of the dice to toggle the safe mode on. For example, on a first roll, the number "4" may be selected as the indicator whether or not safe mode will be toggled on/off. In this example, if the player rolls a "4," safe mode will be activated. On the next roll, the number "8) may be randomly selected as the safe mode toggle number. If the player then rolls an "8," safe mode will be toggled off. Safe mode could be set for a certain number of rolls, or a single roll. In some embodiments, safe modes could be accumulated, or alternatively used for only a single roll.

Another feature that may be implemented with the award-enhancing opportunities using a die/dice is a dice splitting feature. Where multiple dice have the same value (e.g. two "2s," two "3s," etc.), the dice may be split and used in additional award-enhancing manners. An example is described in connection with FIGS. 12A, 12B and 12C, where like reference numbers are used to refer to like items.

In this example, it is assumed that a player is rolling dice in a bonus event of a gaming activity (although it could alternatively be conducted as the primary gaming activity). As shown in FIG. 12A, a first roll 1200 of two dice could provide a roll result 1202, which is a roll of a "1" and a "3" in this example. The table of FIG. 12B indicates an example of a paytable for dice rolls, which correlates potential winning values (e.g. multipliers) in column 1208 for a particular roll in column 1206. For the first roll 1200 having the result 1202, the player rolled a "4," which corresponds to a winning multiplier of "4×" 1204 as depicted by columns 1206 and 1208 of FIG. 12B. Similarly, a second roll 1210 could provide a roll result 1212, which in the illustrated embodiment results in a multiplier of 2× 1214. A third roll 1216 could provide a roll result 1218 having a multiplier of 3× 1220, etc.

In the illustrated example, the fourth roll 1222 results in a roll result 1224 having the same value on both dice, which is a pair of "3s" in this example, which is also referred to as rolling a "6" the hard way. According to the example table of FIG. 12B, this results in awarding a "4×" multiplier. The roll result 1224 of a pair invokes the dice splitting feature, where each of the "3s" 1226, 1228 rolled in this first level-A 1230 is used in another roll in a next level, shown as level-B 1232 in this example. The roll result 1234 (including newly rolled die 1238 and existing/split die 1226) and roll result 1236 (including existing/split die 1228 and newly rolled die 1240) are then considered for payouts, multipliers and/or other awards. In the illustrated example, roll results 1234 and 1236 respectively provide "2×" and "4×" payouts as may be determined from the table of FIG. 12B.

As seen by the roll result 1236, yet another pair of dice were rolled (existing/split die 1228 and newly rolled die 1240), which invokes yet another dice splitting feature where each of the "3s" 1228, 1240 rolled in this second level-B 1232 is used in another level shown as level-C 1242. The roll result 1244 (including newly rolled die 1246 and existing/split die 1228) and roll result 1248 (including existing/split die 1240 and newly rolled die 1250) are then considered for payouts, multipliers and/or other awards. In the illustrated example, roll results 1244 and 1248 respectively provide "0×" and "4×" payouts as may be determined from the table of FIG. 12B.

As shown in FIG. 12A, the total multiplier 1252 for rolls associated with level-A 1230, level-B 1232 and level-C 1242 is "14×," which is the aggregate multiplier value of each of the individual levels 1230, 1232, 1242. Rolling the "7" at roll result 1244 ends the split feature. A fifth roll 1254 results in a roll result of "7," thereby ending the bonus or primary gaming event as the table of FIG. 12B indicates.

Thus, in one embodiment of this feature, the player rolls a pair of dice, and it is determined whether the player rolled a number the "hard way" (e.g. two "2s," two "3s," etc.). If so, the dice are then split, and an additional die is provided to the player for each of the split die. The original dice are locked, but the two new dice are rolled by the player, making two new dice roll results. The player can advance to the next level provided they roll at least one new pair (e.g. hardway), and do not roll any "7s." In one embodiment, rolling new pairs results in new splits, although this need not be the case.

In another embodiment of the split feature, the splitting of dice is integrated with the normal game play, where multipliers are awarded for each roll without the involvement of "levels" as shown in FIGS. 12A and 12C. In such an example, rolling a terminating roll (e.g. "7") during a split feature can end the gaming event. For example, the split dice features could be implemented as shown in Table 1 below:

TABLE 1

| ROLL # | ROLL RESULT | WIN |
|---|---|---|
| 1 | "3" & "1" = 4 | 4X |
| 2 | "5" & "3" = 8 | 2X |
| 3 | "3" & "2" = 5 | 3X |
| 4 | "3" & "3" --> SPLIT | 4X |
| 5 | "3" & "3" --> SPLIT<br>"5" & "3" = 8 | 6X |
| 6 | "1" & "3" = 4<br>"4" & "3" --> END | 4X; END |

In the above examples, the player's split dice don't change. For example, if a pair of "3s" are split, then the threes are locked. This means that the resulting new sets will each contain at least one "3." An alternative embodiment is to split the dice and allow the player to roll both dice in each set instead of just one.

Participation in such a split feature may be made in connection with a primary gaming event and/or bonus gaming event. Betting may be accomplished with or without an additional wager or bonus bet. For example, in one embodiment the feature may not be available unless an additional wager is placed.

Another feature that may be implemented in connection with the disclosure is a progressive mode. In one embodiment, the progressive mode allows eligible players to qualify for progressive awards by satisfying certain criteria. Eligibility for the opportunity to qualify may be implemented, such as the player wagering at certain bet levels (bet rate), side bets, playing on particular machines, etc. Representative examples of qualifying criteria include, but is not limited to, achieving a total multiplier value, achieving a total credit value, and/or reaching a particular number of consecutive rolls of a certain category(s), type(s), value(s), bucket(s), etc. Further representative examples include achieving a particular number of free spins, reaching a particular quantity of rolls of the dice, reaching a particular quantity of duplicate rolls of the dice, etc. Progressive games could be standalone, linked, etc. There could be multiple progressive levels, based on achieving certain criteria.

As a more particular example, there may be a multi-level progressive award associated with one embodiment of a dice rolling bonus or primary gaming event. Eligibility for the progressive award may involve a bonus side bet in one embodiment. Progressive awards may be awarded as a result of particular sequences of dice rolls accomplished by a player shooting dice in accordance with the gaming events described herein. For example, a player that rolls consecutive "12s" (i.e. pair of "6s") may be rewarded the 1$^{st}$ level progressive award. As another representative example, a player that rolls a gold "3," a gold "5," a gold "9," and a gold "11" in sequence may win the top level progressive award.

In addition to single-player embodiments, the features described herein may be implemented in multi-player embodiments. Representative examples of such multi-player embodiments are now described, and include features such as a multi-player tournament mode, and group play which may involve a community bonus mode.

A first multi-player embodiment described is a tournament mode, where gaming machines are linked together, and players participate in the dice rolling feature(s) to reach certain goals or milestones. Such goals/milestones could include, for example, any one or more of a total multiplier value achieved, a total credit value achieved, reaching a particular number of consecutive rolls of a certain category(s), type(s), value(s), bucket(s), etc. Other representative goals/milestones may include a total number of free spins achieved, a quantity of dice rolls, etc.

In one embodiment, the quantity of duplicate rolls may represent a goal/milestone to which multiple players seek to reach. For example, the duration of a tournament could be established by a predetermined or randomly identified quantity of duplicate dice rolls, such as twenty "12" rolls. In such a case, the first player to reach twenty "12" dice rolls wins the tournament, and that particular tournament or tournament segment ends.

In another embodiment, a number of counters or "buckets" may be provided for one, more or all of the numbers capable of being rolled on the dice. For example, a bucket could be provided for each number capable of being rolled, where the first player to roll at least every available number X times (e.g. five times) thereby fills each "bucket," and consequently wins the tournament or tournament segment.

In yet another embodiment involving "buckets," counters or "buckets" may be provided for one or more categories, in lieu of or in addition to the use of other buckets. For example, buckets may be established for each of the "hard way" (e.g. pair) rolls of the dice. As a more particular example, a counter or bucket could be provided for a hardway goal where the first player to roll ten pairs or "hardways" wins the tournament or tournament event. Multiple buckets for multiple pairs can be established. The "hardway" category is described for purposes of example, as any category/categories of dice roll combinations and counts may be implemented.

The "tournaments" described herein for one or more players to participate may be associated with bonus activities of gaming events, and/or primary gaming events. Thus, the tournaments may be initiated when one or more players' actions invoke dice rolling features as described herein, or the tournaments may be primarily directed to the dice rolling features described herein.

Tournaments could be organized or created in numerous manners. One representative example is for tournaments to be organized through a casino where the gaming machines reside. The casino may organize such tournaments for promotional or marketing purposes, or other reasons. In some embodiments, players become eligible for tournaments based on some criteria, such as total credits played, comps credits achieved, level of play, loyalty programs, randomly, and/or other criteria. In other embodiments, groups of players that wager amounts sufficient to quality can be eligible for tournaments. For example, a group of players could determine or select a buy-in amount to qualify, and participate in a tournament and play against each other for the prizes. In such a scenario, the casino could rake a portion of the buy-in. In addition to playing against a single or group(s) of players, the player(s) could also play against the machine, if they so desired. In such an embodiment, the machine (e.g. slot machine) may be configured to act as if it was another player.

The duration or terminating event of a tournament may be established in numerous manners. The duration could correspond to a set period of time, such as 10 minutes, or any amount of time. Such a time duration for a tournament or tournament segment could be set or configured by the machine operator, groups of players, randomly selected, etc.

In another embodiment, the duration of the tournament could be set by a player or one or more groups of players reaching a criterion or criteria. This could include, but is not limited to, single or multiple players in a team achieving a total multiplier value, total credit value, a total number of free spins, a total quantity of dice rolls, reaching a certain number of consecutive dice rolls of a particular category(s), type(s), value(s), bucket(s), etc.

In another embodiment, the duration may be set based on a quantity of duplicate dice rolls. As previously described, a player(s) or team reaching a quantity of duplicate rolls may identify a winner and terminate the tournament or tournament event. For example, the duration of a tournament could be established by a predetermined or randomly identified quantity of duplicate dice rolls, such as twenty "12" rolls. In such a case, the first player to reach twenty "12" dice rolls wins the tournament, and that particular tournament or tournament segment ends. Similarly, reaching count values (e.g. "filling buckets") may also end a tournament or tournament segment, such as when a player has reached a winning level such as rolling every available number X times, thereby filling each bucket. Reaching count values for category buckets (e.g. rolling X hardway/pairs) can also signal the end of a tournament or tournament segment. These are merely examples, as the tournaments may also end in other manners.

Another embodiment of the dice rolling feature described herein involves group play, which may involve a community bonus mode. The group play involves multiple players, such as at a bank of gaming machines, whether a physical bank or via a virtual link(s). Multiple players can participate in the group play, which provides a community style of the dice rolling feature described herein.

For example, when a community bonus event is triggered, all of the eligible players are presented with the dice rolling feature described herein. When the community bonus is presented, the dice are rolled. Awards may be presented and allocated to players. Multiple rounds or levels may be played before the bonus terminates. While examples of the group play may be described in terms of the dice rolling feature being a bonus event of a primary gaming activity, the dice rolling feature may be the primary gaming activity.

Figure 13:
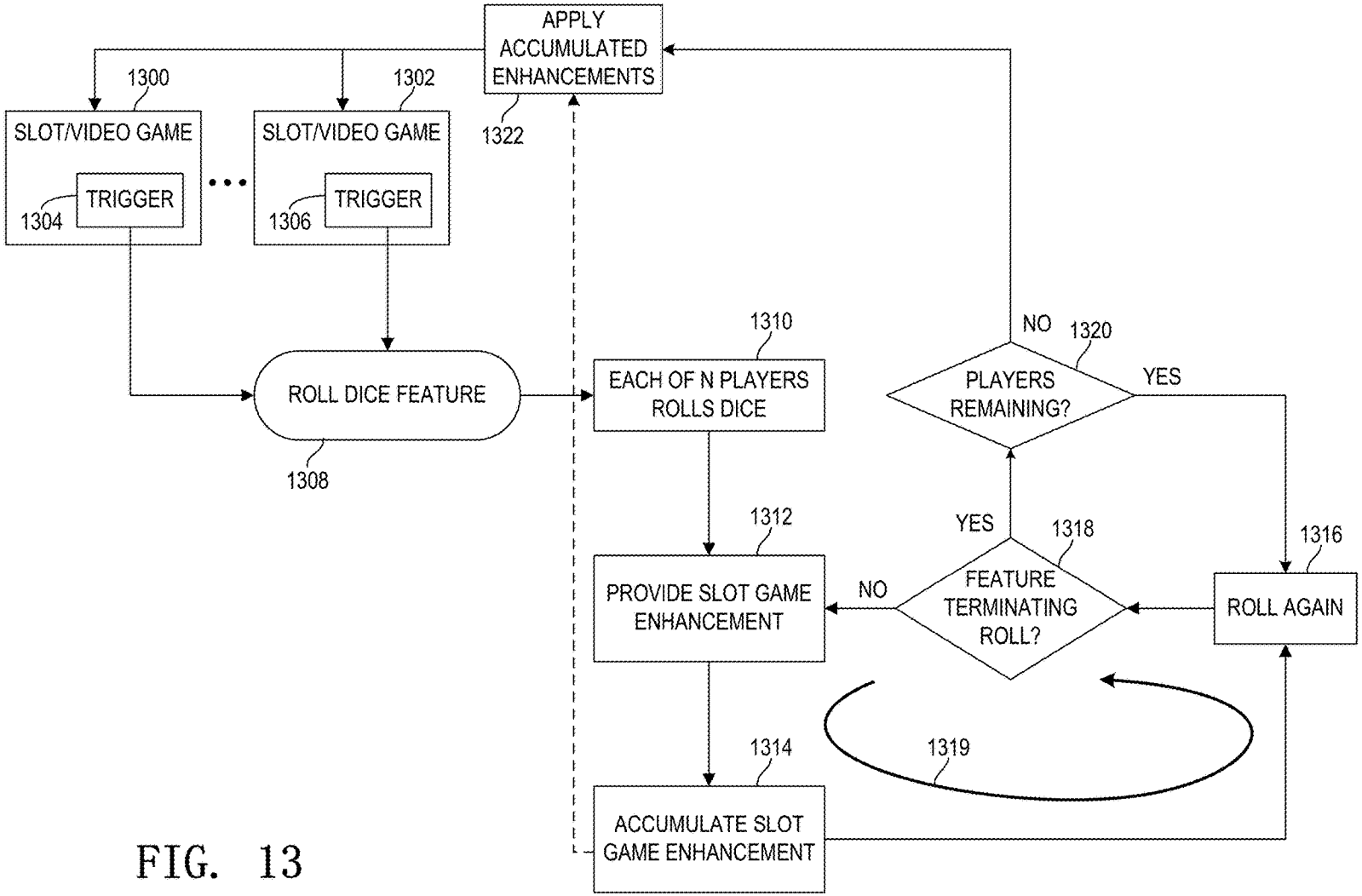
FIG. 13 illustrates an example of a multi-player embodiment involving group play, where a plurality of players participate in a common roll dice feature.

FIG. 13 is an example of a multi-player embodiment involving group play, where a plurality of players participate in a common roll dice feature. In this embodiment, multiple slot/video games are involved, such as slot/video game 1300 through slot/video game 1302. For example, the games 1300, 1302 may represent slot games where mechanical or virtual/electronic reels or other symbols in display segments are "spun" or otherwise rearranged to provide a random presentation of the symbols. When certain symbols are presented in a matching fashion, or otherwise conform to symbol arrangement rules, the result is a winning symbol combination(s) in which payouts may be made when implemented in a wagering environment.

Each of the players participating in a respective slot/video game 1300, 1302 may play a primary gaming activity independently. In the illustrated embodiment, the roll dice feature 1308 is initiated upon the occurrence of any one or more of the triggering events 1304, 1306 occurring in one or more of the slot/video games 1300, 1302. As an example of such a triggering event, assume the game 1300 represents a slot game, in which case the presentation of a predetermined number of a particular symbol may trigger the roll dice feature 1308 for a plurality of the players who are engaged in the slot/video games 1300, 1302. As a more particular example, the trigger 1304 may involve obtaining three established bonus symbols anywhere on the presented "reels" or other display segments of the primary gaming event 1300.

The roll dice feature 1308 of the embodiment of FIG. 1 includes multiple players rolling at least one die, as shown at block 1310. As a result of rolling the die/dice 1310, one embodiment involves providing a slot game enhancement 1312. In this embodiment, the player is guaranteed at least one slot game enhancement 108, although other embodiments may disallow any slot game enhancement if the result of the die/dice roll is a terminating roll. In the illustrated embodiment, the first roll of the die/dice results in one or more players obtaining at least one slot game enhancement 1312. The slot game enhancement, also referred to herein as an award-enhancing opportunity, represents some potential or actual benefit to the player, as described in connection with FIG. 1. Slot game enhancements 1312 may be provided only to the player who rolled the dice resulting in the enhancement, or the enhancements may be additionally provided to or otherwise shared with one, more or all of the other players engaged in the roll dice feature 1308.

In the illustrated embodiment, acquired slot game enhancements may be accumulated by one or more players participating in the roll dice feature, as shown at block 1314. In one embodiment, this involves enabling repetition of the dice rolling 1310, 1316 and identification of slot game enhancements 1312, and accumulating 1314 any provided slot game enhancements. This repetition is depicted in FIG. 13 by enabling a further roll 1316 of the dice, and determining if the result of the dice roll 1316 represents a terminating roll as determined at decision block 1318. If not, a slot game enhancement 1312 is again provided to the rolling player and possibly one or more of the other players, based on the result of the die/dice roll. This can continue to repeat, as depicted by arrow 1319, until it is determined 1318 that a terminating roll has occurred. In one embodiment, a terminating roll terminates the roll dice feature 1308 for the player who has rolled the terminating roll, while in other embodiments a player rolling a terminating roll may also end the roll dice feature 1308 for one or more of the other players.

As players may be eliminated from the roll dice feature 1308 due to rolling a terminating roll, one or more additional players of the group may not yet be eliminated. For example, in an embodiment where only the player rolling the terminating roll (e.g. "7" on a second or greater roll) is eliminated from the feature 1308, it is determined whether any additional players are remaining as depicted at block 1320. If so, the remaining players may roll again 1316, and continue with the roll dice feature 1308 until rolling a terminating roll.

When no players are remaining in the feature, the feature ends, and the accumulated enhancements may be awarded to the players as noted at block 1322. The awarding of enhancements may be applied as the enhancements are awarded, and are not necessarily applied when all players have been eliminated from the feature. Representative examples of payouts in multi-player embodiments are set forth below.

Thus, a group play or community mode may be triggered, whereby a plurality of eligible players are presented with the roll dice feature 1308. Assuming for purposes of example that the triggering event triggers a "bonus" event, the roll dice feature 1308 is presented in response to at least one player triggering the bonus event, whether by activity in a primary gaming event, randomly, etc.

Eligibility for the group play (also referred to herein as community play, community mode, etc.) may be based on various criteria. For example, eligibility may be randomly determined, triggered by a player(s) through gaming activities played, earned by wagering a bonus bet or side wager, or wagering a certain threshold or doing so over a specified duration, etc. Another example involves earned eligibility for accumulating points, credits, values, multipliers, bonus changes and/or other items over a time or until an event(s) occurs. Still another example involves earned eligibility by a player(s) who pays for a chance to play the community play, such as a direct pay-to-play wager. In another example, the feature may be triggered by a single player, or any other player(s) at a gaming machine bank, whether the gaming machines are physically linked or virtually linked via one or more networks. These and other eligibility requirements, taken alone or in combination with other such eligibility requirements, may be used in connection with the group play dice roll feature described herein.

Each player in a community environment may "roll" the dice in various manners. Dice rolls may be initiated automatically by the gaming machine, or could be initiated by the player. Players may roll individually, or may roll as a group. Rolls by multiple players may occur concurrently or on a per round basis, or could occur sequentially with each player rolling the dice when it is his/her turn.

In one embodiment, all players associated with the eligible community of players may get a chance to roll the dice, or only players who meet certain criteria may be given a chance to roll. Dice rolls could be granted randomly to each player or all players, or could be earned/accumulated through game play either in the dice roll feature or from eligibility criteria in the base/primary game prior to triggering the feature. Further, the number of dice rolls could be fixed, or could be dynamic or mapped to roll results and criteria. The number of rolls could be attached to a player's performance or roll history, another player's performance or roll history, the group's performance or roll history, etc. These and other manners of facilitating rolling the dice in connection with the dice rolling feature may be utilized.

As in a single-player embodiment, various awards may be awarded to players of the group. For example, awards may include credit values, multipliers or other mathematical enhancements, free spins or other free play events, bonus retriggers, progressive jackpots, changes to play parameters (e.g., the "safe 7s" variation described above), prizes, promotions, comps (i.e. complementary items), etc. Anything that may provide an asset to a player, increase the player's chances of obtaining an asset or a higher asset, or other benefit to the player may be awarded.

Awards may be allocated in various manners. For example, awards may be allocated individually to players, or to the group of players. Awards may be allocated to players or groups of players that meet certain criteria, such as, for example, players that wager the maximum amount to get premium awards versus players who wager less or the minimum. As another example, awards may be allocated to individuals or groups of players at the same or different rates. For example, players wagering the maximum amount may win more than players wagering a lesser amount. These and/or other allocation methodologies may be utilized.

Group play, tournament play, or other multi-player embodiments may be subject to a particular mode(s). For instance, tournaments/group play could be configured for certain modes of game play based on the various awards configurations. In one embodiment, the players could opt to play a specific mode of the game where the goal of the tournament is to reach the highest multiplier.

One exemplary tournament/group play mode may be a variation of the game where the players in the community play accumulate bonus multipliers. Another exemplary tournament/group play mode may involve other benefits to players, such as free spins. A free spin mode is a variation of the game where the players in the community play accumulate free spins. Multipliers and/or free spins could be mapped to results of dice rolls. Players could take turns rolling the dice or roll the dice individually, and thus may occur sequentially or concurrently. Multipliers and/or free spins could, for example, increment individually to each of the players meters or to a community meter. Players could be awarded multipliers/free spins based on their own roll results, based on the results of the group, etc. Rolling a "7" (and/or other terminating roll) could terminate the entire community round or just eliminate the eligibility of the player that rolled the "7."

Other embodiments may involve accumulating multiple assets or benefits to the players, such as both multipliers and free spins. For example, an alternative free spin mode embodiment may involve players in the community play accumulating multipliers applied to each free spin. Players roll the dice for multipliers that may be added together and applied to current free spins in a community free spin event. Free spin multipliers could, for example, increment individually to each of the players' meters or to a community meter. Players could be awarded multipliers based on their own roll results, based on the results of the group, etc. Rolling a "7" (and/or other terminating roll) could terminate the entire community round or just eliminate the eligibility of the player that rolled the "7".

Group play, such as a multi-player community bonus, enables multiple players to share the dice rolling features during respective participation in gaming activities. In one embodiment, the community-based experience allows community participants to benefit from the initiation of disclosed dice rolling features by any member playing at the physical or virtual machine bank. In one embodiment, providing multiple players with the opportunity to receive awards from the community play may present a challenge in dice rolling embodiments that involve a predetermined bonus value. For example, it may be undesirable to lessen the value of the bonus for the initiating player, but all community players may also be unable to receive a reward equal to that of the initiating player while preserving feature initiation frequency. Thus, in one embodiment, the game feature rewards players for being part of the community without significantly detracting from the original dice rolling feature experience. Examples of particular embodiments of group play involving the dice rolling feature are now described. It should be recognized that these disclosed embodiments are provided for purposes of facilitating an understanding of the group/community play, and are not intended to be limiting to other embodiments described herein and/or recognizable by those skilled in the art from the description provided herein.

In a first representative embodiment, initiation of a community dice rolling feature is initiated by a member of the community obtaining a scatter symbol combination configured to initiate the community play. In this embodiment, it is also assumed that each of the players of the community may respectively participate in a primary gaming activities such as slot games, and collectively enter the community bonus when at least one of the members achieves the designated scatter symbol combination (or one of a plurality of activating scatter symbol combinations). In this representative embodiment, players become eligible to be drawn into the community dice rolling feature by any player (including himself/herself) activating the feature, where the player has met some eligibility criteria. For example, eligibility criteria in the present example may be that the player has spun the reels of his/her primary gaming activity with all lines played at least once in the previous ten seconds.

In this example, each die is a standard, fair, six-sided die. When multiple players are shooting dice in the dice rolling bonus feature, each player may be assigned a pair of uniquely colored (or other distinguishing) dice. Upon initiation of the feature, and assuming a bank of physical machines (e.g. four slot machines), the entire bank of overhead monitors for each machine may change to provide a collective display for purposes of carrying out the community dice rolling feature. In one embodiment, the player that initiated the bonus is presented with the dice to roll. All eligible players at the bank may be presented with a graphic that prompts them to select a pair of lucky numbers for the duration of the bonus feature. An example of a set of lucky numbers is provided in Table 2 below:

TABLE 2

| | |
|---|---|
| 2 or 12 | Pay value-1 - (highest) |
| 3 or 11 | Pay value-2 |
| 4 or 10 | Pay value-3 |
| 5 or 9 | Pay value-4 |
| 6 or 8 | Pay value-5 (lowest) |

Thus, a player could select the lucky numbers of 2 or 12, which provides the highest pay value, but has the lowest likelihood of being rolled. In one embodiment, the lucky numbers pay table amounts (e.g. Pay value-1, Pay value-2, etc.) is based upon the respective player's wagers over a preceding time, such as the last 60 seconds, and the odds for rolling the selected pairs. The lucky number pay table of Table 2 may also take into account the number of players eligible for the dice rolling feature at the time of its initiation.

Each participating player therefore selects a pair of lucky numbers (e.g. from a lucky number paytable such as that shown in Table 2), and the initiating player begins rolling the dice in the manners described herein. The initiating player may collect credits according to the previously-described dice roll feature, and the other eligible players at the bank are rewarded the value in their selected lucky numbers when the initiating player rolls one of their selected pairs. Thus, in a community play embodiment, good dice rolling may be advantageous to all, creating a cooperative community activity. Previously-describe variations, such as "hardway" splits described in connection with FIGS. 12A-12C, progressive jackpots, and/or other variations described herein may be applied in the community bonus feature.

Figure 14:
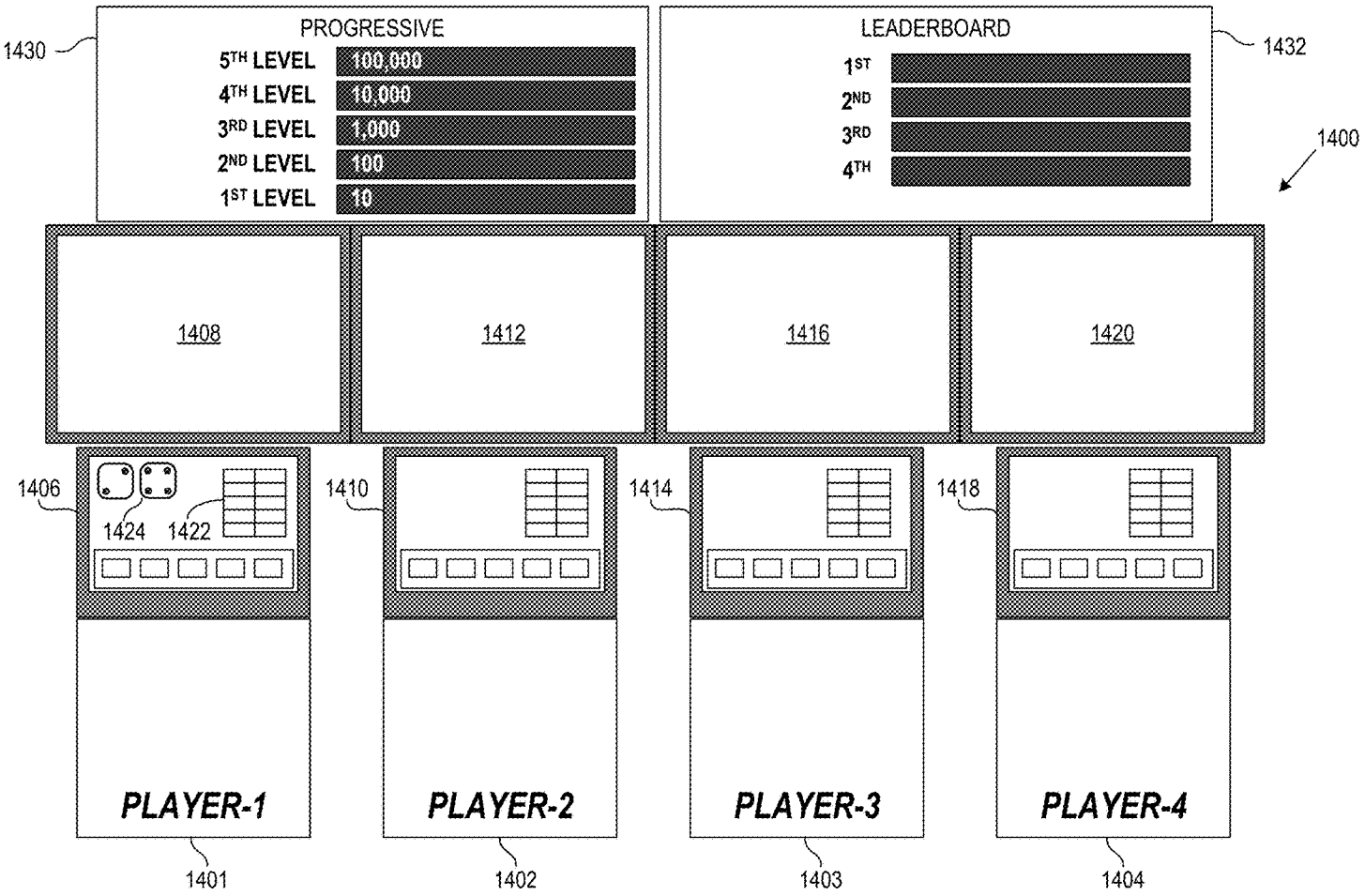
FIG. 14 illustrates a representative bank of gaming machines in which multi-player tournaments and/or group play activities may be implemented.

For purposes of example and not of limitation, FIG. 14 illustrates a representative bank 1400 of gaming machines in which multi-player tournaments and/or group play activities may be implemented. In this example, four gaming machines 1401, 1402, 1403, 1404 are part or all of the gaming machine bank 1400. Each of the gaming machines includes at least one display device to present gaming activities from primary gaming activities and bonus gaming activities. In the illustrated embodiment, each gaming machine includes to display areas. Gaming machine 1401 includes display areas 1406, 1408; gaming machine 1402 includes display areas 1410, 1412, gaming machine 1403 includes display areas 1414, 1416, and gaming machine 1404 includes display areas 1418, 1420. The first displays, such as display areas 1406, 1410, 1414, and 1418, may present information such as the lucky number pay table 1422, the dice 1424 in which the player will roll, etc., although this may alternatively or additionally be presented on a different or additional display.

Displays 1408, 1412, 1416, 1420 may present information such as the slot game or other primary game(s) associated with the respective gaming machine 1401, 1402, 1403, 1404, and may also present bonus activity such as the community dice roll feature. In one embodiment, each display 1401, 1402, 1403, 1404 serves as an independent display for its respective machine, until the community bonus is invoked, which in response the displays 1401, 1402, 1403, 1404 may change to provide one aggregate display where dice rolling occurs. Thus, in one embodiment, dice rolling on any machine 1401, 1402, 1403, 1404 traverses the display border into the other display areas. In other embodiments, the dice rolling features may be separately displayed, such as duplicated, on each of the displays 1401, 1402, 1403, 1404. Progressive jackpot information, leaderboard information and/or other information may be presented as shown at blocks 1430, 1432.

FIGS. 15A-15D depict an example of the progression of a representative multi-player roll dice bonus feature. In this embodiment, it is assumed that three players are connected physically and/or via a network(s), although the principles apply to any plurality of community players. Like reference numbers are used throughout FIGS. 15A-15D to refer to like items where appropriate.

Figure 15A:
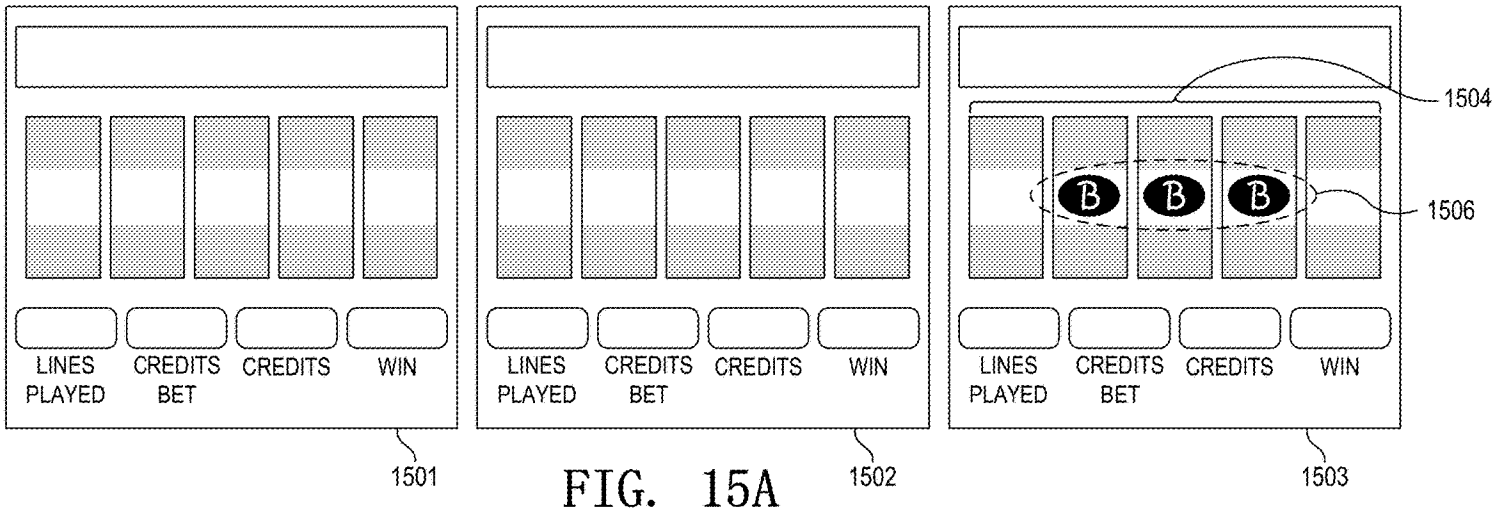
FIGS. 15A-15D depict an example of the progression of a representative multi-player roll dice bonus feature.
Figure 15B:
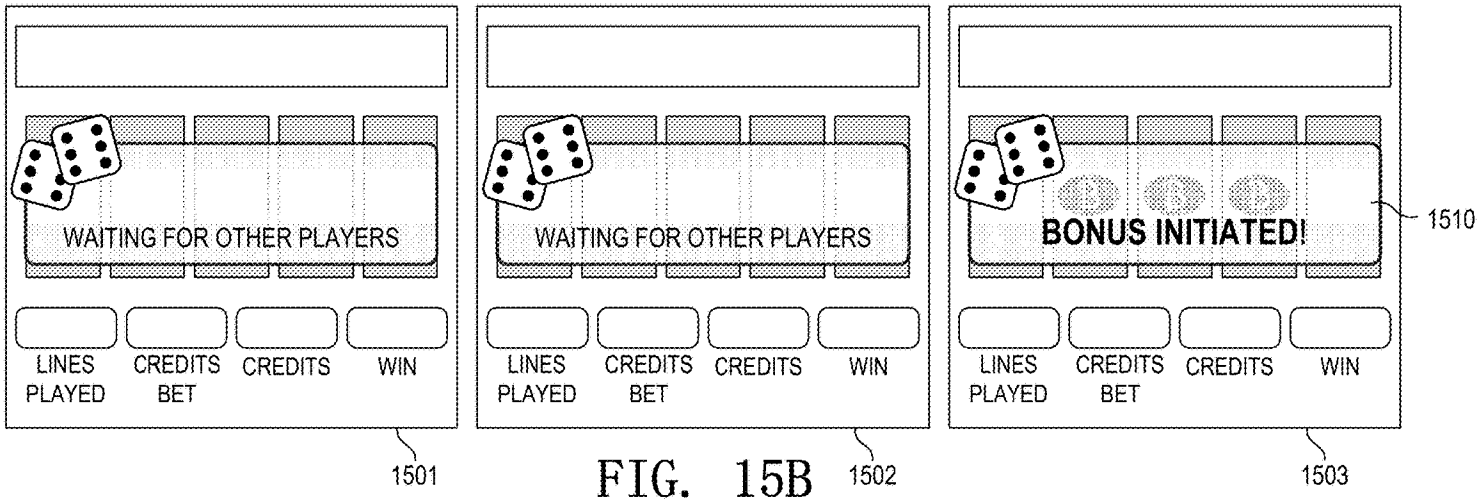

Referring first to FIG. 15A, three displays 1501, 1502, 1503 are associated with respective gaming machines (not shown). An example of a multi-player, community roll dice feature is described in connection with these three displays 1501, 1502, 1503. In the illustrated embodiment, display 1503 utilizes a set 1504 of reels on which a primary slot game may be played. When a triggering symbol combination 1506 is attained, the community dice roll feature is initiated. As shown in FIG. 15B, a message 1510 may be displayed to indicate that the community bonus has been initiated. All eligible players may then go to the community bonus.

In one embodiment, the initiating player waits for other eligible players to make their lucky numbers selection, such as that described in connection with Table 2. In one embodiment, each eligible player is presented with an individual "lucky number" table based on his/her respective betting history. Thus, the amount wagered, time of play, number of paylines played, and/or other defined criteria may be used in determining what a particular player's lucky number table amounts will be. In other embodiments, one or more community players are presented with a lucky number table without selection.

Each player picks the numbers that they believe the initiating player will roll during the bonus game. If the number rolled by the initiating player, represented at display 1503 in this example, matches the community player's selected "lucky numbers," they will be awarded credits (and/or other player assets) based on their lucky number paytables.

Figure 15C:
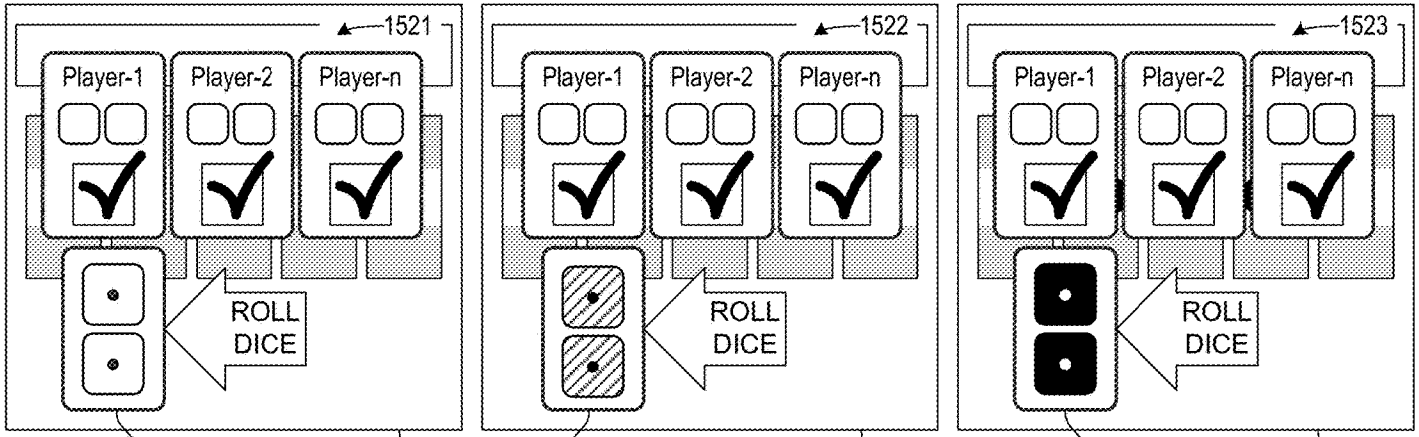

The initiating player begins his/her bonus round and rolls dice for credits. FIG. 15C shows dice 1513 associated with the initiating player in this example. This player may roll the dice 1513 until rolling a terminating roll, such as a "7." Rolling may be implemented using any user interface functionality, including using a touch screen where the player can place a finger(s) on the dice and slide the dice to initiate the roll. Assume that the player of display 1503 rolls an "8," and is awarded credits, multipliers, free spins and/or other player asset, based on a paytable such as, for example, those described in connection with FIG. 5, FIG. 7 and/or FIG. 9. For instance, using the paytable of FIG. 5, the player would be awarded a 2× multiplier for rolling an "8." Other community players (i.e. those who were not the initiating player in this example) who selected the "8," such as by selecting the "6 or 8" in the example of Table 2 above, is also awarded credits, multipliers and/or other assets based on his/her lucky numbers selection.

Figure 15D:
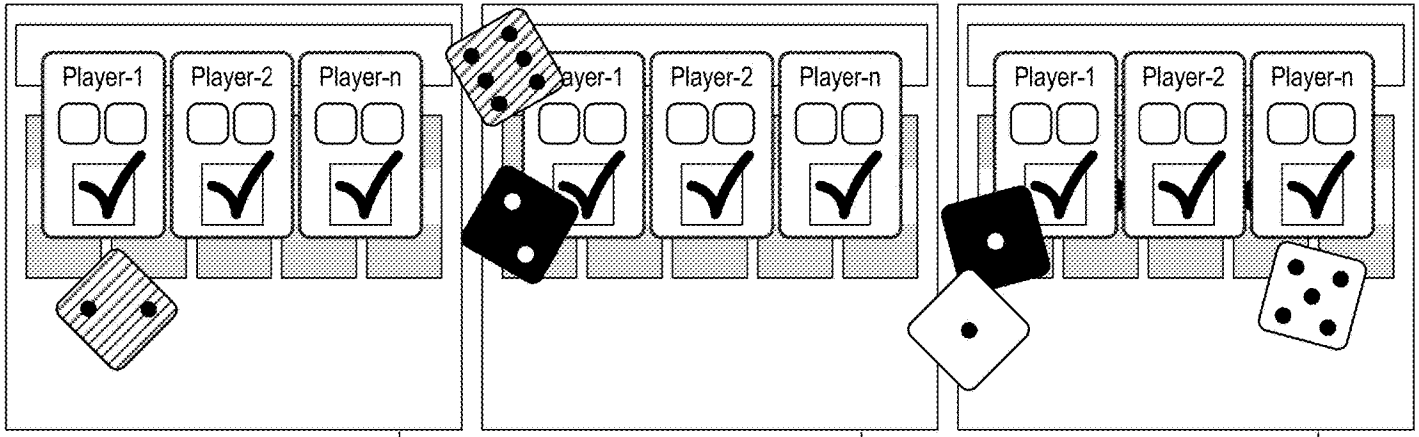

In the case of a pair or "hardway" being rolled, one embodiment involves splitting the pair as previously described. In one embodiment, the split is made with at least one other community player, such that the rolling player and the at least one other community player are provided with one of the two dice having the same pips value. In such an instance, the other community player also rolls dice (e.g. dice 1511 shown on display 1501). Both rolling players receive awards based on a paytable, and the remaining players receive awards based on their respective lucky numbers selection. Even when one of the rolling players rolls a terminating roll (e.g. "7"), he/she may remain in the bonus round as a community player receiving awards based on those players who are still rolling the dice. In one embodiment, the presentation of such dice rolls is such that the dice roll among multiple displays 1501, 1502, 1503 as depicted in FIG. 15D. In one embodiment, when all rolling players roll a terminating roll, the community bonus ends, and credits are tallied and awarded to each participating player.

In other embodiments, all eligible players roll their own set of dice during the community bonus. For example, each eligible player is provided with a set of dice, depicted in FIG. 15C as dice sets 1511, 1512, 1513. Player roll indicators 1521, 1522, 1523 enable each player to see what each of the participating players has rolled. In this embodiment, players may take turns rolling, or two, more or all players may roll concurrently. In one embodiment, prior to rolling their respective dice, each eligible player is assigned or selects numbers from a lucky numbers paytable, and is awarded the commensurate amount when other players roll the assigned/selected numbers. When all players have rolled a "7" (except on the first roll in some embodiments), the community bonus ends.

Using computing structure, a computer-readable medium may be provided that has instructions stored thereon that are executable by the computing structure to perform methods described herein. For example, in one embodiment, a computer-readable medium is provided that has instructions stored thereon which are executable by a computer system by performing steps including facilitating single or multi-player participation in a gaming event, presenting at least one die, identifying an award-enhancing opportunity in response to a number presented on the at least one die, enabling repetition of the presentation of the at least one die and the identification of the award-enhancing opportunity in response to the number presented until a triggering event occurs by way of the presentation of the at least one die, enabling aggregation of the identified award-enhancing opportunities occurring during the repetition, and enhancing payout opportunities relative to the participation in the gaming event using the aggregation of the identified award-enhancing opportunities. Multi-player embodiments may include computer-executable instructions to enable group and/or tournament play, such as enabling a group of two or more players to select or otherwise be assigned numbers that can provide player assets based on the dice rolling features described herein, comparing player outcomes in tournament situations, etc. Computer-executable instructions may perform any of the dice rolling features described herein, with the further assistance of processors, displays, storage and/or other mechanisms where appropriate. Multi-player embodiments may utilize processors and instructions as each gaming machine, may access a processor(s) and instructions from a central site such as a server, whether locally or remotely such as via a network(s), etc.

In another representative embodiment, a computer-readable medium is provided that has instructions stored thereon which are executable by a computer system by performing steps including facilitating participation in a gaming event, presenting at least one die, identifying a mathematical augmentation value in response to a number presented on the at least one die, providing a quantity of guaranteed repetitions of the presentation of the at least one die and the identification of the mathematical augmentation value in response to the number presented, following the guaranteed repetition enabling conditional repetition of the presentation of the at least one die and the identification of the mathematical augmentation value in response to the number presented until a triggering event occurs by way of the presentation of the at least one die, and enhancing payout opportunities relative to the participation in the gaming event using the identified mathematical augmentation values.

The principles described herein can also be applied to other electronic wagering games such as video poker. For example, the player can participate in a video poker game where dice may be rolled in connection with a resulting hand(s) in the manners described above. In one particular embodiment, a dice roll event may be allowed upon completion of every resulting hand, upon obtaining a particular poker rank, upon obtaining at least a particular poker rank, upon receiving a mystery bonus, upon payment by the player of a side wager, etc. In this representative embodiment, the player may obtain enhanced payouts through multipliers provided by way of the dice, free hands (analogous to free spins) provided by way of the dice, etc. Thus, in some embodiments, the dice roll features described herein may be implemented as a secondary game to various electronic gaming and casino-based primary games. In such embodiments, the dice roll feature may be a bonus feature triggered randomly or in connection with some predetermined event(s), or may be provided in connection with each primary gaming event.

As described above, a game enhancement feature including dice may be used as multipliers to modify primary poker games. For example, a roll of dice might be triggered prior to an initial hand being dealt, or in a draw poker style game, either before an initial hand is dealt or prior to replacement cards being shown after a draw. The dice roll may be a single dice roll to provide a multiplier for any awards won on the associated poker hand, or may be used as a multiplier for future poker hands. In other embodiments, a player may continue to roll the dice until a feature-ending condition is reached, such as a predetermined number being displayed on the dice or predefined number of rolls (or rounds) being completed. FIGS. 16, 17A-17D, 18, and 19A-19F illustrate some of these example embodiments.

Figure 16:
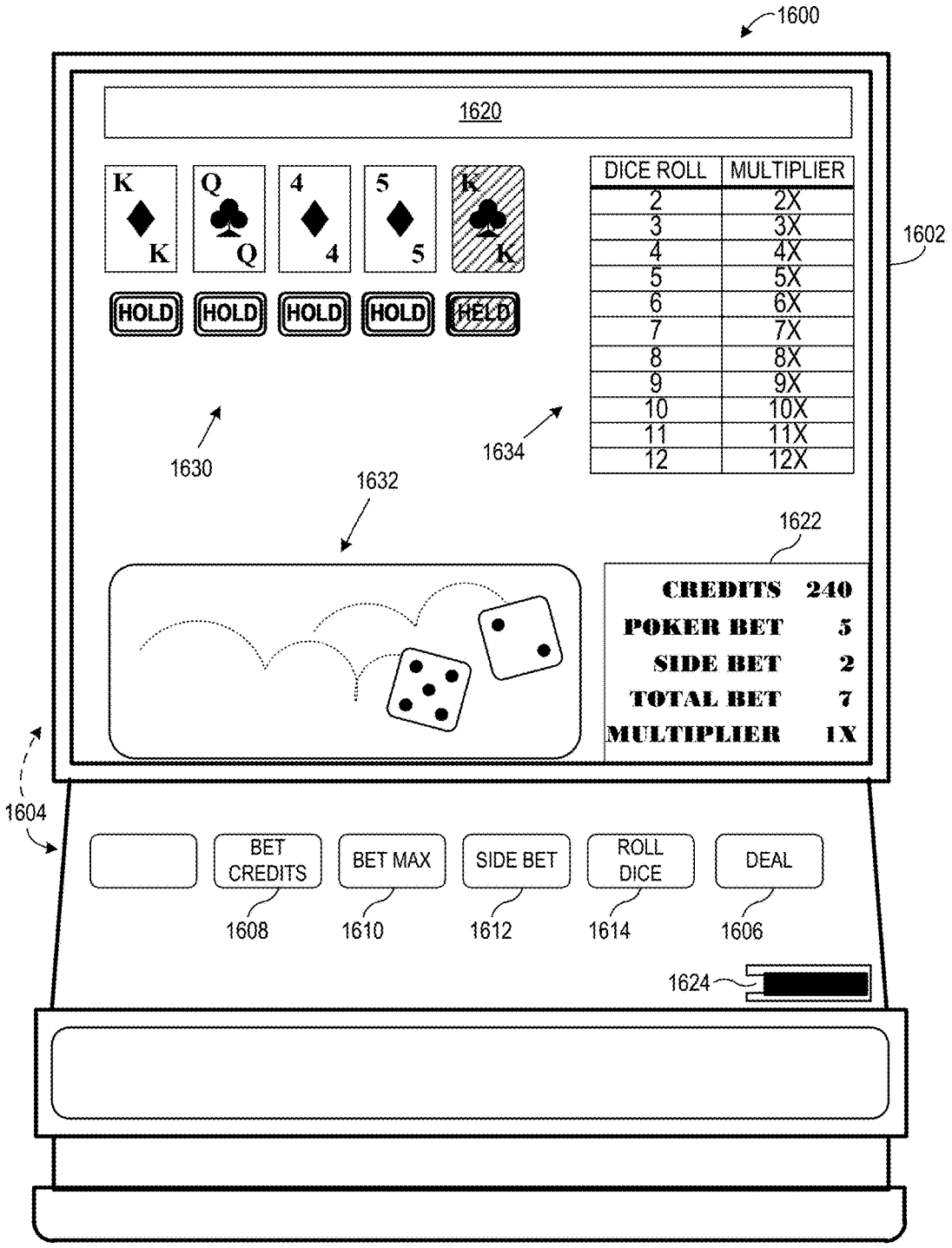
FIG. 16 illustrates a representative embodiment of a poker-style gaming device in which the principles of the present invention may be implemented.

FIG. 16 illustrates a representative embodiment of a poker-style gaming device in which the principles of the present invention may be implemented. Referring to FIG. 16, a gaming machine 1600 includes a computing system (not shown) to carry out operations according to the invention. The illustrated gaming machine 1600 includes a display 1602, and a user interface 1604, although some or all of the user interface 1604 may be provided via the display 1602 in touch screen embodiments.

The user interface 1604 allows the user to control and engage in play of the gaming machine 1600. The particular user interface mechanisms associated with user interface 1604 is structured, in this embodiment, for play of video poker. For example, the user interface 1604 may include one or more buttons to hold cards and deal/draw cards, although other functions may be used with other types of poker games. In addition, the user interface 1604 may allow the user to enter coins, bills, or otherwise obtain credits through vouchers, tokens, credit cards, tickets, etc. It is through the user interface 1604 that the user can initiate and engage in gaming activities involving embodiments described herein. For example, the user can use the user interface 1604 and/or touch screen inputs to deal 1606 a poker hand, and/or draw a replacement cards in a draw poker embodiment. Additionally, the player may be able to bet 1608 a number of credits on each hand wagered, make gaming decisions such as place a maximum wager 1610 or place secondary or side bets 1612, initiate when the die/dice will be rolled 1614, etc. For example, in one embodiment, the user may be eligible for the roll dice feature described herein when placing a maximum wager, or placing a side bet, or other condition for eligibility. In other embodiments, there is no such eligibility, and the player may be eligible to receive the roll dice feature in the normal course of participating in the gaming event, which may or may not be based on rules indicating when the roll dice feature will be presented to the player. While the illustrated embodiment of FIG. 16 depicts various "buttons" for the user interface 1604, it should be recognized that a wide variety of user interface options are available for use in connection with the present invention, including pressing buttons, touching a segment of a touch-screen, entering text, entering voice commands, or other known user entry methodology.

The display device 1602 may include one or more of an electronic display, and fixed display information such as information such as paytable information associated with a glass/plastic panel 1620 on the gaming machine 1600. A display segment or panel 1622 may also be provided to display information such as the accumulated credits, wager amount on the poker hand, and side bets, the total wager placed, multiplier values such as a multipliers received through the dice feature described herein, the number of credits paid out or "won" on a particular play, etc. A wager acceptor 1624 is operative to receive wager tokens, coins, bills, credit/debit cards, coupons, smart cards, prepaid casino cards, electronic fund transfer (EFT), tickets, and the like.

In the illustrated embodiment, the gaming machine is involved in a poker gaming event 1630 that may represent the primary or native gaming event in which the player is participating. In this embodiment, the gaming event 1630 is depicted to be a draw poker game, where a player may use touch screen buttons or buttons on the user interface 1604 to hold cards and deal/draw cards. As previously described, embodiments described herein involve a roll dice feature that is depicted at display area 1632 where the resulting state of the dice may be presented (although audio and/or other manners of notifying the player of the resulting dice roll may instead or additionally used). Depending on the embodiment, a table 1634 or other potential award notification area may be provided to enable the participant to know the results of the dice roll feature during participation in the feature and/or after the feature has concluded.

In the illustrated embodiment, the table 1634 shows that for a single roll of the dice, a player receives the value of the resulting dice as a multiplier for the primary poker game 1630. That is, any awards won in the primary poker game when the dice feature is activated, is multiplied by the received multiplier. In other embodiments, the multiplier may not be directly associated with the number shown on the dice. For example, a table, such as the one shown in FIG. 10 may be used, where a player can win up to "10×" an award received in the primary poker game, or not win any multiplier if a "7" is received on the dice roll. As mentioned above, a player may receive only a single roll of the dice to generate a multiplier for modifying any awards won in the primary poker game, or multiple rolls may be generated to accumulate a multiplier, bonus credits, free games, etc. as described above.

In other embodiments, a player may receive a consolation prize if a dice feature is triggered, but no award is received in the primary poker game. For example, if a multiplier of "5×" is awarded in a dice feature, but the final poker hand of an associated poker game results in no award, the gaming device may award the player five credits (the value of the multiplier in credits). In other embodiments, the consolation prize may be predefined fixed prize, such as two credits, or may be associated with the dice value or multiplier value in a table. Alternatively, the consolation prize may be determined at random from a table of possible prize values.

In some embodiments, multiple poker hands may be played during the same primary game. For example, in a "Triple-Play" poker game, three poker hands are provided where cards held in the first poker hand are also revealed and held in the other two poker hands. When a draw is requested, separate replacement cards are used to replace non-held cards in each of the three poker hands. Separate decks may be used to determine the replacement cards for each hand, or a common deck may be used for all replacement cards. If a dice feature is triggered in a multiple poker hand embodiment, the multiplier or modifier awarded in the dice feature may be used to multiply or modify awards won on each of the multiple poker hands. Alternatively, the multiplier or modifier awarded in the dice feature may be used to only modify the highest winning hand of the multiple hands, or may multiply or otherwise modify one or more of the awards associated with the multiple hands according to other rules. In other embodiments, the each hand may have a separate set of dice used to generate a multiplier or other modifier, or the same set of dice may be rolled multiple times to generate multipliers or modifiers for each hand or poker level.

As described above, a bonus dice feature may have a mystery or random trigger, or may be trigged by symbols or other conditions occurring on a primary or base game. The dice may be "rolled" by the player, such as by swiping a finger over the touchscreen image of the dice, or the dice may be auto-rolled by the gaming device. Some embodiments may allow the player to choose whether to roll the dice themselves, or have the dice "auto-rolled." In other embodiments, a dice feature may be used in as a community bonus for a group of poker games using features similar to those described above for tournament or community bonus games.

Figure 17A:
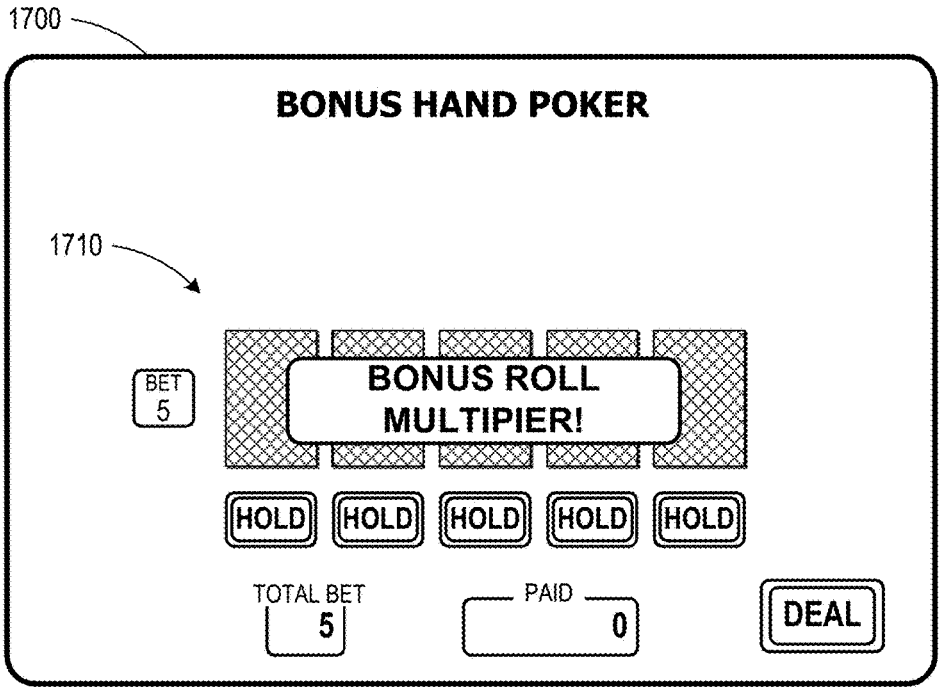
FIGS. 17A-17D depict an example of the progression of a representative poker-style gaming device having an award-enhancing feature according to embodiments of the invention.

FIGS. 17A-17D depict an example of the progression of a representative poker-style gaming device having an award-enhancing feature according to embodiments of the invention. Referring to FIGS. 17A-17D, a gaming display 1700 includes a draw poker game 1710 and a dice roll feature 1720 that is randomly triggered prior to an initial hand being dealt, or prior to replacement cards being shown after a draw. The resulting multiplier from the dice roll feature is used to multiply or modify any awards won on the primary poker game 1710. In FIG. 17A, it is indicated that a bonus roll feature is triggered prior to dealing a poker hand 1710.

Figure 17B:
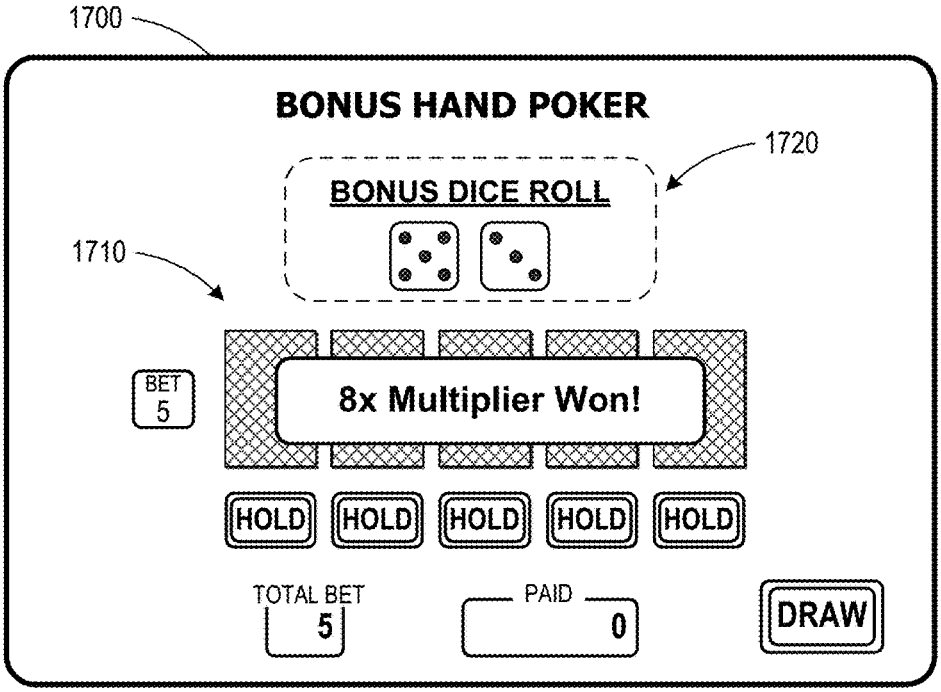
Figure 17C:
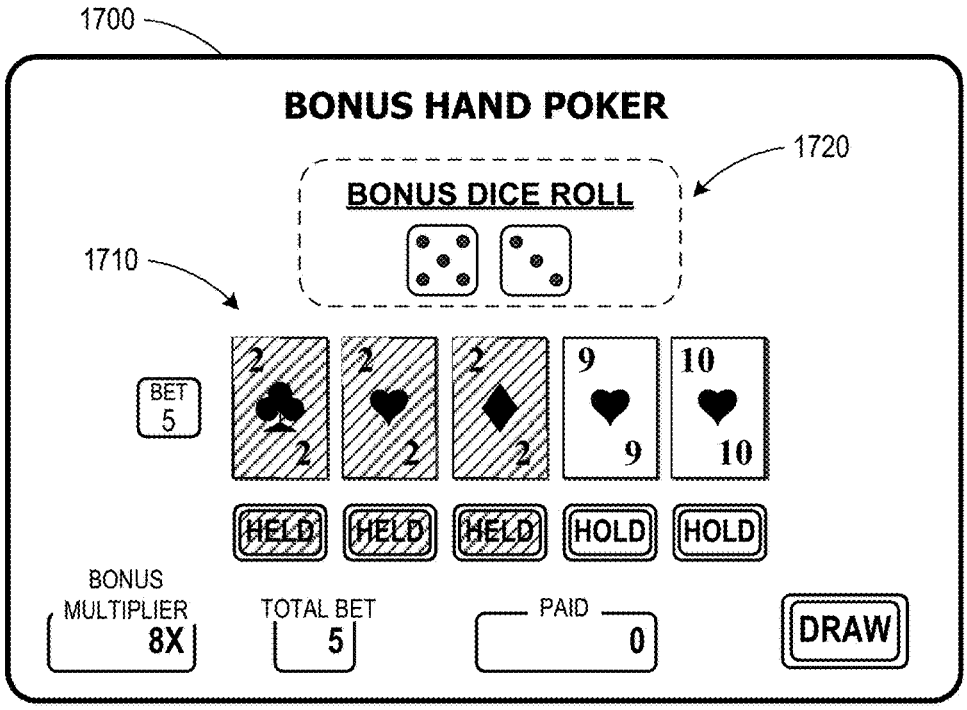
Figure 17D:
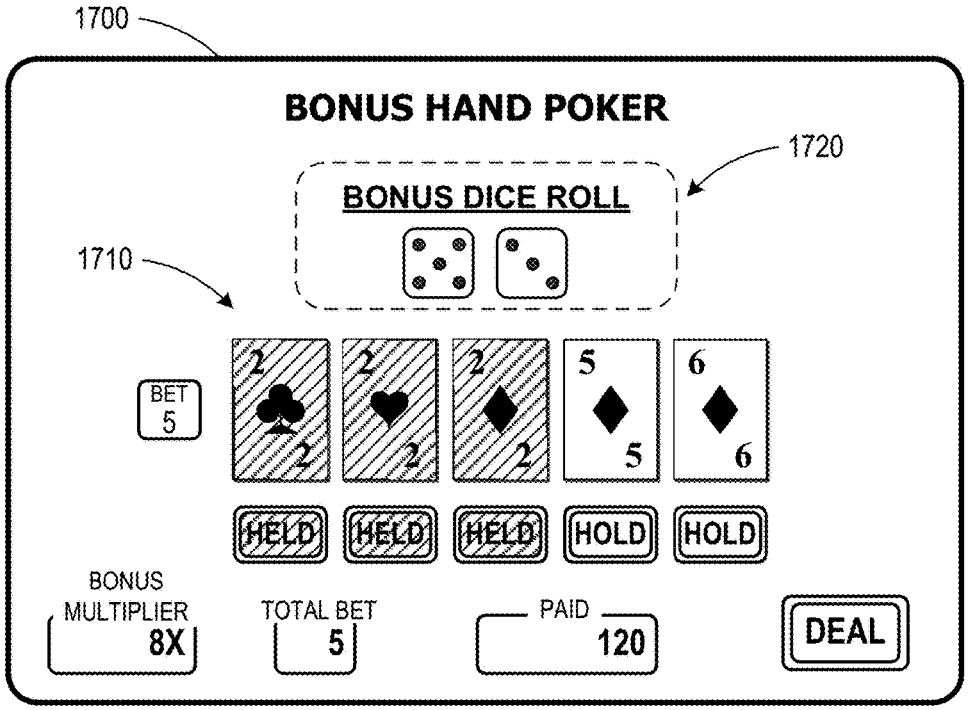

In FIG. 17B, a pair of dice 1720 has been activated a rolled to show a result of "8" (that is, a five and a three, which are combined to get eight). In this embodiment, the result of the roll is the multiplier that is received for the feature. Here, since the player has rolled an "8," the player receives an "8×" multiplier. The cards 1710 are then dealt in FIG. 17C, where the player holds the three twos (2C-2H-2D). The player then draws replacement cards to replace the two cards not held, and the result is shown in FIG. 17D. Here, the replacement cards did not improve the hand, but the player still has received a final hand 1710 with a three-of-a-kind, which has an associated award of 15 credits for a 5 credit wager. In addition, these 15 credits are multiplied by the "8×" multiplier to give a total award of 120 credits to the player.

Figure 18:
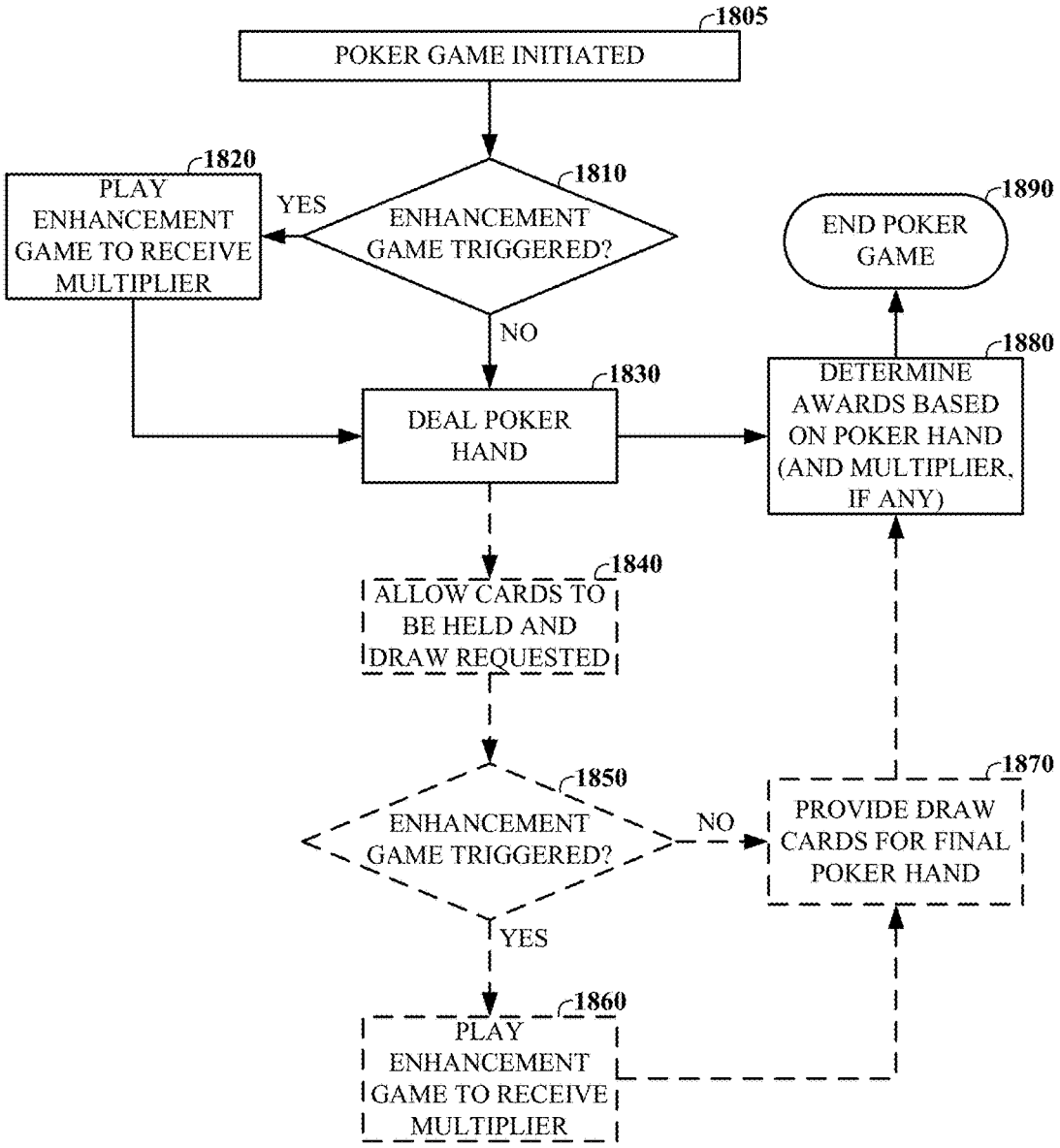
FIG. 18 is a flow diagram of a representative embodiment in which award opportunities in a primary poker game are enhanced using a die/dice according to embodiments of the invention.

FIG. 18 is a flow diagram of a representative embodiment in which award opportunities in a primary poker game are enhanced using a die/dice according to embodiments of the invention. Although FIG. 18 shows a flow diagram of a primary poker card game embodiment, any primary or base game type is possible in other embodiments. Note that the dashed processes are optional if the poker game is a draw poker game, whereas the solid boxed processes can be used for a draw poker base game or stud poker base game. In process 1805, a poker hand is dealt. It is determined in process 1810 if an enhancement dice feature is triggered, such as the bonus dice roll feature to achieve a multiplier as described above. If an enhancement game is triggered, the bonus enhancement game is played in process 1820 to receive a multiplier. Afterwards, or if the enhancement game was not triggered in process 1810, a poker hand is dealt in process 1830. If it is a stud poker game, the operational flow progresses to process 1880 where awards are determined based on the poker hand and any multipliers received in an enhancement game. The poker game then ends at 1890. If it is a draw poker embodiment, the operational flow optionally progresses to process 1840 from process 1830 (after the initial poker hand is dealt) where cards in the dealt poker hand are allowed to be held, until a draw is requested. In process 1850, it is again determined whether an enhancement dice game is triggered. Although for draw poker games it is shown that an enhancement game can be triggered both before the initial deal and prior to draw cards being revealed, in some embodiments the enhancement game may be triggered only at one of these two events. Returning to process 1850, if the enhancement game is triggered, the enhancement game is played and a multiplier is received in process 1860. If the enhancement game was not triggered, the operational flow proceeds directly to process 1870 where the draw cards (if any) are revealed for the final poker hand. This final poker hand is again evaluated to determine awards in process 1880, and whether any multiplier has been received to modify awards associated with the final poker hand.

FIGS. 19A-19F illustrate embodiments utilizing an interactive dice feature to enhance video poker games. Similar techniques may be used with other types of wagering games such as video slots, mechanical slots, video blackjack, video keno, etc. In these embodiments (FIGS. 19A-19F), games of poker where new wagers are placed (i.e., new bets) are played between dice rolls. The dice may be rolled prior to each new game to provide a modifier for the base game or additional prize one or more times with each played poker base game until a bonus ending event occurs. In other embodiments, however, multiple primary games may be played between dice rolls (i.e., bonus rounds) without the need for additional wagers or bets. For example, part of a free-spin bonus game may include a roll of the dice followed by a spin of game reels, followed by a second roll of the dice and spin of the game reels. This pattern may continue until a bonus-ending number on the dice is rolled, a bonus ending event occurs on the reels, a predefined number of bonus-free games is played, or another type of bonus event occurs. In other embodiments, multiple dice rolls may occur between poker games, without the dice feature terminating. For example, a player may be given two dice rolls to accumulate a multiplier for a poker game, the poker game may be played, and then the player receives two more rolls to accumulate another multiplier for the next poker game, which requires a separate wager from the first poker game.

FIGS. 19A-19F illustrate an example game progression using a video poker base game according to embodiments of the invention. The game progression shown in FIGS. 19A-19F potentially includes multiple rounds of dice rolls in between wagered-on poker games. That is, the dice may be rolled prior to each poker game to determine an independent multiplier for the following poker game. Additionally, the bonus dice feature is triggered by an event happening in a previous game, as will be shown below with respect to FIG. 19A.

Referring to FIG. 19A, a game display 1900 includes a poker hand 1910 that is played using five card draw poker rules. A bonus with multiple rounds is triggered when, in this embodiment, a Joker having dice symbols 1911 appears in the final poker hand. The deck of cards used for the poker hand may include two jokers where only one joker has dice symbols. Other embodiments may use other triggering methods, such as by randomly placing dice symbols on one of the 52 standard playing cards prior to a deal, where the bonus is triggered when the card with the dice appears in the poker hand. After the bonus has been triggered, a bonus roll zone 1920 (or bonus display 1920) becomes active for the next poker base game. As shown in FIG. 19B, the player has placed another wager, and now has the opportunity to receive a multiplier by which any award from the base poker hand 1910 will be multiplied. Although two dice are shown in this embodiment, a single die, or three or more dice could be used. Additionally, in a community bonus embodiment, players may have separate sets of dice to roll, or each player's die/dice may be used together to generate a community bonus modifier. The player may activate the dice 1925 by swiping their finger across the display screen 1900 to mimic rolling the dice toward the roll zone 1920. A multiplier meter 1907 may show a multiplier that will be used to modify any awards associated with a final poker hand.

In this embodiment, an award table for the outcome of the dice may be used, such as Table 3 below:

TABLE 3

| COMBINED DICE VALUE | MULTIPLIER |
|---|---|
| 2 | 20X |
| 3 | 5X |
| 4 | 4X |
| 5 | 3X |
| 6 | 2X |
| 7 | BONUS OVER - 1X |
| 8 | 2X |
| 9 | 3X |
| 10 | 4X |
| 11 | 10X |
| 12 | 25X |

In FIG. 19C the dice 1925A and 1925B have been rolled and have a combined value of "11." As indicated in Table 3, this combined dice value has a correlated multiplier of "10×," which is shown in the multiplier meter 1907. Note that this is the poker game following the game that triggered the dice feature bonus. As shown in FIG. 19D the final poker hand 1910 has resulted in a pair of kings which has an associated award of 5 credits. This award is multiplied by the "10×" multiplier for a total award of 50 credits. Each subsequent game that is wagered on will be preceded by the dice being rolled and a new modifier/multiplier until a bonus-ending condition is met. Referring to FIG. 19E, a next poker game is played with another round of the bonus. Here, the dice have been rolled to show a combined value of "2," which correlates to a "20×" multiplier, which replaces any previously multiplier in the multiplier meter 1907, and is used to modify any awards won in the following base poker game. In this case, the base poker hand 1910 has not resulted in a final poker hand with an associated award, so the multiplier does not help add or modify any award. In FIG. 19F, the next poker game has been wagered on. Here, however, the dice have been rolled to show a "7," which ends the bonus and does not provide the player with a multiplier for the current poker hand. That is, the value of "7" ends the bonus and has an effective multiplier of "1×" for the current poker game that is about to be played. In other embodiments, the player may receive a final multiplier for poker hand that is about to be played. In still other embodiments, other terminating conditions may be used to end the dice feature as described above, such as the player receiving a set number of games with a dice roll. In this embodiment, once a bonus-ending condition has been received the bonus immediately ends and the player does not receive a multiplier for the current poker hand.

Although the embodiments of FIGS. 19A-19F have the dice associated with multipliers, other modifiers or awards are possible in other embodiments. For example, some or all of the combined dice outcomes may be correlated to credit values, free games/spins/hands, bonus symbols to be used in the base game, or other types of awards. In one example, rolling doubles may be associated with multipliers while rolling other dice combinations may be associated with bonus credits that are won for subsequent poker or slot games.

In yet other embodiments, poker hands may be evaluated to determine if the player receives another dice roll for a modifier in the next poker hand. For example, a player may need to receive a winning hand (or a hand above a certain threshold) to be eligible for another dice roll in the next poker game. This may also be used in multi-hand embodiments, where each level or hand of the multi-hand game may be used to determine if the corresponding level or hand of a subsequently-played poker game receives a dice roll for a new multiplier/modifier, or maintains the same multiplier/modifier from the previous game at the same level or hand. For example, in a "Triple-Play" poker embodiment, where the first and third hands have winning final poker hands, the player may get to roll dice prior to the cards in the next poker game being shown to receive multiplier for the first and third hands of that next poker game. However, since the hand at level two (or the second hand) did not result in a win, the second hand or level in the subsequent poker game is not associated with a multiplier or modifier.

From the description provided herein, those skilled in the art are readily able to combine software created as described with appropriate general purpose or special purpose computer hardware to create a mobile computer system and/or computer subcomponents embodying the invention, and to create a mobile computer system and/or computer subcomponents for carrying out methods of the invention.

The foregoing description of the exemplary embodiments has been presented for the purposes of illustration and description. It is not intended to be exhaustive or to limit the invention to the precise form disclosed. Many modifications and variations are possible in light of the above teachings.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out herein.

What is claimed is:

1. A method of operating a gaming device including a display, a user interface, a memory configured to store a credit amount, a wager acceptor structured to receive physical currency or physical currency based tickets, and a processor, the method comprising:

receiving a signal from the wager acceptor indicating receipt of physical currency or physical currency based tickets;

increasing the credit amount in memory based upon the received signal from the wager;

receiving a signal on the gaming device to initiate a poker game having a predefined number of card positions associated with a poker hand, the signal indicating a wager amount, where the credit amount is reduced by the wager amount;

determining if a dice feature is randomly triggered after the signal is received to initiate the poker game, and prior to displaying the poker hand of the poker game, where the determination of whether the dice feature is randomly triggered is independent of the poker hand;

randomly rolling at least one die to generate a bonus multiplier prior to displaying the poker hand of the poker game when the dice feature is randomly triggered, wherein randomly rolling at least one die to generate a bonus multiplier includes:

rolling the at least one die in a first round of the dice feature, determining a first-round multiplier based on a value shown on a face of the at least one die rolled in the first round of the dice feature, determining if a terminating event has occurred in the first round of the dice feature, when a terminating event has not occurred in the first round of the dice feature, initiating subsequent rounds of the dice feature to determine subsequent round multipliers until the terminating event has occurred after a round of the dice feature, and aggregating the first-round multiplier with any determined subsequent round multipliers to generate the bonus multiplier;

selecting a plurality of cards to present in the card positions of the poker game;

evaluate the poker hand to determine awards associated with the poker hand;

multiply any determined awards associated with the poker hand by the bonus multiplier if the dice feature has been randomly triggered; and increase the credit amount in memory based on the awards.

2. The method of claim 1, wherein the bonus multiplier is generated by setting the value of the multiplier to a value shown on a face of the die after rolling.

3. The method of claim 1, wherein a plurality of dice are used in the dice feature, and wherein bonus multiplier is generated by summing values shown on faces of the dice after rolling.

4. The method of claim 1, wherein the bonus multiplier is generated by ascertaining a predefined multiplier value from a table based on a value shown on a face of the at least one die after rolling.

5. The method of claim 1, further comprising awarding a consolation prize when a dice feature is triggered and the evaluated poker hand is not associated with any awards.

6. The method of claim 5, wherein the consolation prize is an award equal to the value of the bonus multiplier.

7. The method of claim 5, wherein the consolation prize is a predefined award.

8. The method of claim 1, wherein the consolation prize is randomly selected from a plurality of awards.

9. The method of claim 1, wherein two dice are used in the dice feature, and wherein the terminating event occurs when the values shown on the faces of the two dice after the first round of the dice feature or after a subsequent round of the dice feature have a sum of 7.

10. A method of operating a gaming device including a display, a user interface, a memory configured to store a credit amount, a wager acceptor structured to receive physical currency or physical currency based tickets, and a processor, the method comprising:

receiving a signal from the wager acceptor indicating receipt of physical currency or physical currency based tickets;

increasing the credit amount in memory based upon the received signal from the wager acceptor;

receiving a signal on the gaming device to initiate a draw poker game having a predefined number of card positions associated with a poker hand, the signal indicating a wager amount, where the credit amount is reduced by the wager amount;

determining if a first dice feature is randomly triggered prior to displaying a dealt poker hand of the draw poker game, where the determination of whether the dice feature is randomly triggered is independent of the dealt poker hand;

randomly rolling at least one die to generate a first bonus multiplier prior to displaying the dealt poker hand of the draw poker game when the first dice feature is randomly triggered;

selecting a plurality of cards to present in the card positions of the draw poker game as the dealt poker hand;

holding any cards in the dealt poker hand as indicated by signals received from the user interface;

receiving a signal from the user interface indicating a draw request;

determining if a second dice feature is randomly triggered prior to displaying replacement cards for any cards not held in the dealt poker hand, where the determination of whether the second dice feature is randomly triggered is independent of the dealt poker hand and the replacement cards;

randomly rolling at least one die to generate a second bonus multiplier prior to displaying replacement cards for the dealt poker hand of the draw poker game when the second dice feature is randomly triggered;

selecting replacement cards to replace any cards not held in the dealt poker hand to generate a final poker hand;

evaluating the final poker hand to determine awards associated with the final poker hand;

determining a final bonus multiplier from the first bonus multiplier and the second bonus multiplier;

multiplying any determined awards associated with the final poker hand by the final bonus multiplier if the first dice feature or second dice feature has been randomly triggered; and increasing the credit amount in memory based on the awards.

11. The method of claim 10, where each of the first dice feature and second dice feature include rolling two dice.

12. The method of claim 11, wherein the first bonus multiplier is generated by summing values shown on faces of the two rolled dice in the first dice feature; and wherein the second bonus multiplier is generated by summing values shown on faces of the two rolled dice in the second dice feature.

13. The method of claim 10, wherein in the final multiplier is determined by taking a higher value between the first bonus multiplier and the second bonus multiplier.

14. The method of claim 10, wherein in the final multiplier is determined by aggregating the first bonus multiplier with the second bonus multiplier.

15. The method of claim 10, further comprising awarding a consolation prize when a first dice feature is triggered or a second dice feature is triggered, and the evaluated final poker hand is not associated with any awards.

16. The method of claim 15, wherein the consolation prize is an award equal to an aggregate value of the first bonus multiplier and the second bonus multiplier.

17. The method of claim 15, wherein the consolation prize is a predefined award.

18. A method of operating a gaming device including a display, a user interface, a memory configured to store a credit amount, a wager acceptor structured to receive physical currency or physical currency based tickets, and a processor, the method comprising:

receiving a signal from the wager acceptor indicating receipt of physical currency or physical currency based tickets;

increasing the credit amount in memory based upon the received signal from the wager acceptor;

receiving a signal on the gaming device to initiate a first poker game having a predefined number of card positions associated with a first poker hand, the signal indicating a wager amount, where the credit amount is reduced by the wager amount;

selecting a plurality of cards to present in the card positions of the first poker game;

evaluating the first poker hand to determine first awards associated with the first poker hand;

increasing the credit amount in memory based on the first awards;

determining if a dice feature is triggered based on the first poker game;

randomly rolling at least one die to generate a first bonus multiplier;

receiving a signal on the gaming device to initiate a second poker game, the signal indicating a wager amount, where the credit amount is reduced by the wager amount;

selecting a plurality of cards to present in the card positions of the second poker game to form a second poker hand;

evaluating the second poker hand to determine second awards associated with the second poker hand;

multiplying the second awards with the first bonus multiplier;

increasing the credit amount in memory based on the multiplied second awards;

determining if a bonus terminating event has occurred; and randomly rolling the at least one die to generate a second bonus multiplier to be used with a third poker game when a bonus terminating event has not occurred.

19. The method of claim 18, wherein the bonus terminating event occurs when a predetermined number is rolled on the at least one die.

20. The method of claim 18, wherein the dice feature is triggered when a random symbol appears on a card in the first poker.

* * * * *